US008506729B2

(12) United States Patent
Oikawa et al.

(10) Patent No.: US 8,506,729 B2
(45) **Date of Patent: *Aug. 13, 2013**

(54) AUSTENITE-TYPE STAINLESS STEEL HOT-ROLLING STEEL MATERIAL WITH EXCELLENT CORROSION RESISTANCE, PROOF-STRESS, AND LOW-TEMPERATURE TOUGHNESS AND PRODUCTION METHOD THEREOF

(75) Inventors: Yuusuke Oikawa, Tokyo (JP); Shinji Tsuge, Tokyo (JP); Shigeo Fukumoto, Tokyo (JP); Kazuhiro Suetsugu, Tokyo (JP); Ryo Matsuhashi, Chiba-ken (JP); Hiroshige Inoue, Chiba-ken (JP)

(73) Assignee: Nippon Steel & Sumikin Stainless Steel Corporation, Chuo-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/349,866

(22) Filed: Jan. 13, 2012

(65) Prior Publication Data

US 2012/0111457 A1 May 10, 2012

Related U.S. Application Data

(63) Continuation of application No. 12/391,045, filed on Feb. 23, 2009, now Pat. No. 8,105,447, which is a continuation of application No. 11/343,516, filed on Jan. 30, 2006, now abandoned.

(30) Foreign Application Priority Data

Feb. 2, 2005 (JP) ..... P 2005-026176
Feb. 2, 2005 (JP) ..... P 2005-026177
Jan. 20, 2006 (JP) ..... P 2006-012569

(51) Int. Cl.

| | |
|---|---|
| ***C22C 38/44*** | (2006.01) |
| ***C22C 30/00*** | (2006.01) |
| ***C22C 38/42*** | (2006.01) |
| ***C22C 38/48*** | (2006.01) |
| ***C22C 38/50*** | (2006.01) |
| ***C22C 38/54*** | (2006.01) |

(52) U.S. Cl.
USPC ..... 148/327; 148/442; 148/607; 148/608; 148/611; 420/52; 420/53; 420/586.1

(58) Field of Classification Search
USPC ..... 148/327, 442, 605–608, 611, 653; 420/52, 53, 584, 585, 586, 586.1
See application file for complete search history.

(56) References Cited

U.S. PATENT DOCUMENTS

| | | | | |
|---|---|---|---|---|
| 4,302,247 | A | 11/1981 | Abe et al. | |
| 4,341,555 | A | 7/1982 | Douthett et al. | |
| 4,675,156 | A | 6/1987 | Sakamoto et al. | |
| 6,576,068 | B2 * | 6/2003 | Grubb et al. | 148/327 |
| 6,918,968 | B2 * | 7/2005 | Semba et al. | 148/327 |
| 8,105,447 | B2 * | 1/2012 | Oikawa et al. | 148/327 |

FOREIGN PATENT DOCUMENTS

| | | |
|---|---|---|
| JP | 59-006359 | 1/1984 |
| JP | 60208459 | 10/1985 |
| JP | A-01-154848 | 6/1989 |
| JP | 02097649 | 4/1990 |
| JP | 04006214 | 1/1992 |
| JP | 04006215 | 1/1992 |
| JP | 04006216 | 1/1992 |
| JP | A-04-272131 | 9/1992 |
| JP | A-05-320756 | 3/1993 |
| JP | A-07-258800 | 9/1995 |
| JP | A-2002-322545 | 8/2002 |
| JP | A-2003-328087 | 11/2003 |

OTHER PUBLICATIONS

English-hand translation of Japanese patent 59-6359, Yoshifumi Ohmura et al., Jan. 13, 1984.*
Non-final Office Action for U.S. Appl. No. 11/343,516 mailed Feb. 29, 2008.
Japanese Office action mailed Feb. 24, 2009 for Japanese No. 2004-264434.
Non-final Office Action for U.S. Appl. No. 11/343,516 mailed Feb. 29, 2009.
Non-Final Office Action for U.S. Appl. No. 12/391,045 mailed on Apr. 6, 2011, which is no U.S. Patent No. 8,105,447.
Office Action for Japanese Patent Application No. 2005-026176 mailed on Jan. 26, 2010.
Notice of Allowance for Japanese Patent Application No. 2006-012569 mailed on May 24, 2011.

* cited by examiner

*Primary Examiner* — Deborah Yee
(74) *Attorney, Agent, or Firm* — Dorsey & Whitney LLP

(57) ABSTRACT

An austenitic stainless steel hot-rolled steel material can be provided which has sea-water resistance and strength superior to conventional steel. Low-temperature toughness can be maintained, which is preferable in a structural member of speedy craft. The steel material can include an austenitic stainless steel hot-rolled steel material which excels in the properties of corrosion resistance, proof stress, and low-temperature toughness. In such austenitic stainless steel hot-rolling steel material, e.g., PI [=Cr+3.3(Mo+0.5W)+16N] ranges from 35 to 40, δ cal [=2.9 (Cr+0.3Si+Mo+0.5W)−2.6 (Ni+0.3Mn+0.25Cu+35C+20N)−18] ranges from −6 to +2, and a 0.2% proof stress at room temperature is not less than 550 MPa, Charpy impact value measured using a V-notch test piece at −40° C. is not less than 100 J/cm2, and the pitting potential measured in a deaerated aqueous solution of 10% NaCl at 50° C. (Vc'100) is not less than 500 mV (as it relates to saturated Ag/AgCl).

8 Claims, No Drawings

AUSTENITE-TYPE STAINLESS STEEL HOT-ROLLING STEEL MATERIAL WITH EXCELLENT CORROSION RESISTANCE, PROOF-STRESS, AND LOW-TEMPERATURE TOUGHNESS AND PRODUCTION METHOD THEREOF

CROSS REFERENCE TO RELATED APPLICATION(S)

This application is a continuation of U.S. Non-Provisional application Ser. No. 12/391,045 filed Feb. 23, 2009, which is a continuation of U.S. Non-Provisional application Ser. No. 11/343,516 filed Jan. 30, 2006, which claims priority under 35 U.S.C. §119 from Japanese Patent Application No. P2005-026176 and P2005-026177, both filed Feb. 2, 2005 and Japanese Patent Application No. 2006-012569, filed Jan. 20, 2006, the entire disclosures of which are incorporated herein by reference.

FIELD OF THE INVENTION

The present invention relates to a structural steel material which excels in corrosion resistance, and can be used in a marine (chloride) environment, for example; an austenite-type stainless steel hot-rolling steel material, as a hull-structural material which excels in strength as well as seawater resistance, and low-temperature toughness, upon being used as a material for an outer shell, a bulkhead, an frame, a hydrofoil, etc. The present invention also relate to a method for producing such steel material.

BACKGROUND INFORMATION

Conventionally, coated steel sheets to which a heavy corrosive protection was applied were used for hull structures. The demand for speedy craft equipped with hydrofoils etc. has increased. Since high-speed sea water flow can come into contact with the hydrofoils, etc., such use prefers the use of a material which excels in sea water resistance without requiring being coated. In order to reduce hull weight further, a material having a high strength is preferred.

Although austenitic stainless steel can be important as a material which excels in sea water resistance, in a conventional production method, austenitic stainless steel is generally subjected to a solution annealing treatment after hot-rolling, thereby softening the resultant austenitic stainless steel so that the proof stress of the austenitic stainless steel is at most 400 MPa.

The strength can be increased by performing a hot-rolling processing under a specific temperature condition while omitting the solution annealing treatment, which has been described in Japanese Unexamined Patent Application, First Publication Nos. S. 60-208459, H. 2-97649, and H. 4-6214.

In particular, Japanese Unexamined Patent Application, First Publication No. H. 2-97649 describes a production method of an austenitic stainless steel having a high proof stress while maintaining a low-temperature toughness. However, the sea water resistance is not taken into consideration in this austenitic stainless steel while maintaining low-temperature toughness. Although Japanese Unexamined Patent Application, First Publication No. H. 4-6214 describes a production method of an austenitic stainless steel which has a high proof stress of not less than 500 MPa and excellent sea-water resistance, which includes performing a heat treatment on steel which contains 0.3% or more of N and 0.5 to 3.0% of Mo under a specific condition, there is no disclosure in this publication regarding the toughness. of the material The official reports for Japanese Patent Publication Nos. 2783895 and 2783896 describe a production technique of an austenitic stainless steel with little softening of a weld part by adding a Nb-type element.

Cr, Mo, and N are elements which increase sea water resistance, and the corrosion resistance ranking in steel is determined by the formula: PI=Cr+3.3(Mo+0.5W)+16N as a pitting index. When the PI value of the component shown in examples of Japanese Unexamined Patent Application, First Publication No. H. 4-6214 is determined, it is approximately 32 in the minimum case, but as a stainless steel which gives a higher PI value (not less than 35), SUS836L and 890L (which contain 23% or more of Ni) are austenitic types, whereas SUS329J4L (which contains 5.5 to 7.5% of Ni) is a two-phase type.

Since two-phase-type SUS329J4L contains a ferrite phase, SUS329J4L has high proof stress. A two-phase stainless steel known as a super two-phase, in which Mo and W contents are increased has also been developed, and application thereof as a material with high hardness and high corrosion resistance has started. On the other hand, a high strength steel material of an austenitic-type high corrosion resistance stainless steel having a PI value over 35 has not yet been put in practical use.

Stainless steel is more susceptible to crevice corrosion when it is shaped into a crevice form than when it is not shaped i.e. flat. Therefore, in order to produce steel suitable for broad use in hull structures and which is low-maintenance, it is required to develop a highly corrosion-resistant steel material which is higher than the steel material described in Japanese Unexamined Patent Application, First Publication No. H. 4-6214.

On the other hand, the demand for a stainless steel material for ocean-going craft which is reliable when stranded or after a collision between shipping is increasing. Characteristics of both the base material and the weldability are preferred for reliability. Regarding the reliability of the base material, high toughness is preferred in preparation for a collision. Among Cr, Mo and N, which increase corrosion resistance, as for Mo and Cr, it may not be sufficient to simply add, because processability in hot-rolling will significantly decrease likely due to the influence of delta ferrite contained in cast steel or semi-finished products. In addition, in the case of a high Cr and Mo steel, in general, the toughness of the steel deteriorates remarkably due to the influence of an intermetallic compound known as a σ phase, and hence it is necessary to add a large amount of Ni in order to suppress the influence of both. However, considering the rising prices of raw materials of Ni and Mo these days, development of a low-cost, highly corrosion-resistant stainless steel is especially desired. It should be noted that, two-phase steel may not be adopted because of its low-temperature toughness.

On the other hand, as for adding N as described in Japanese Unexamined Patent Application, First Publication No. H. 4-6214, it may be effective for maintaining the strength, however, excessive N causes the generation of bubbles at a welded part, thereby it may decrease the bonding strength and reliability of the welded part, to the contrary.

Thus, it is one of the objects of the present invention to provide an austenitic stainless steel hot-rolled steel material which has sea-water resistance and strength superior to the conventional steel, while maintaining low-temperature toughness, which is required in a structural member of a high-speed ship. Another object of the present invention is to provide an austenitic stainless steel hot-rolled steel material which excels in the properties of corrosion resistance, proof stress, and low-temperature toughness.

The strength, the toughness, and the corrosion resistance of a hot-rolled plate obtained by casting, heat-rolling processing has been reviewed, and it has been determined that it may be preferable to provide a heat treatment of an austenitic component system in which the N amount is not more than 0.35% in view of weldability and the PI value is not less than 35, in view of weldability. In particular, it has been determined that the toughness cannot be determined by only the Ni content, but is determined by the content of intermetallic compounds, which are contained in a steel material, having high Cr and Mo contents. The formation of a metallographic structure as such starts from the solidification of steel, in addition, the formation may be generated at any steps in hot-rolling processing. In particular, the influence of a chemical composition on a solidified structure has been investigated, and the influence of conditions on rough rolling of cast steel, homogenizing heat treatment, hot working, and heat treatment has been reviewed. As a result, it was determined to restrict the content of component elements the solidification structure and the metallographic structure of a steel material to obtain an austenitic stainless steel which can address the problems of the conventional technique and excels in corrosion resistance, toughness, strength, and hot processability, the solidification structure, the metallographic structure of a steel material, thereby completing the austenitic stainless steel of the present invention and the production method thereof.

SUMMARY OF EXEMPLARY EMBODIMENTS OF THE INVENTION

According to one exemplary embodiment of the present invention, an austenitic stainless hot-rolled steel material having excellent corrosion resistance, proof stress, and low-temperature toughness can be provided. Such steel material can include: about 0.001 to 0.03 mass % of C, about 0.1 to 1.5 mass % of Si, about 0.1 to 3.0 mass % of Mn, about 0.005 to 0.05 mass % of P, about 0.0001 to 0.003 mass % of S, about 15.0 to 21.0 mass % of Ni, about 22.0 to 28.0 mass % of Cr, about 1.5 to 3.5 mass % of Mo, about 0.15 to 0.35 mass % of N, and about 0.0005 to 0.007 mass % of O. The PI value can expressed by the following: (1) ranges from about 35 to 40, 8 cal value expressed by the following and (2) ranges from about −6 to +2, the remnant consists of Fe and inevitable impurities, the content of intermetallic compounds contained in the steel material is not more than about 0.5 mass %, a 0.2% proof stress at room temperature is not less than about 550 MPa, the Charpy impact value measured using a V-notch test piece at about −40° C. is not less than about 100 J/cm$^2$, and the pitting potential measured in a deaerated aqueous solution of about 10% NaCl at 50° C. (Vc'100) is not less than about 500 mV (vs saturated Ag/AgCl).

$$PI=\mathrm{Cr}+3.3(\mathrm{Mo}+0.5\mathrm{W})+16\mathrm{N} \quad (1)$$

$$\delta\ \mathrm{cal}=2.9(\mathrm{Cr}+0.3\mathrm{Si}+\mathrm{Mo}+0.5\mathrm{W})-2.6(\mathrm{Ni}+0.3\mathrm{Mn}+0.25\mathrm{Cu}+35\mathrm{C}+20\mathrm{N})-18 \quad (2)$$

In addition, according to further exemplary embodiments of the present invention, the following one or more of certain metallic elements can be included:

a) one or more of about 0.3 to 3.0 mass % of W and about 0.005 to 0.1 mass % of Al.

b) one or more of about 0.3 to 3.0 mass % of W, about 0.005 to 0.1 mass % of Al, about 0.3 to 2.0 mass % of Cu, and not more than about 0.1 mass % of Sn.

c) one or more of about 0.3 to 3.0 mass % of W, about 0.005 to 0.1 mass % of Al, about 0.0005 to 0.0050 mass % of Ca, about 0.0005 to 0.0050 mass % of Mg, and about 0.005 to 0.10 mass % of REM.

d) one or more of about 0.3 to 3.0 mass % of W, about 0.005 to 0.1 mass % of Al, about 0.0005 to 0.0050 mass % of Ca, about 0.0005 to 0.0050 mass % of Mg, about 0.005 to 0.10 mass % of REM, and about 0.0003 to 0.0060 mass % of B.

5) one or more of about 0.3 to 3.0 mass % of W, about 0.005 to 0.1 mass % of Al, about 0.3 to 2.0 mass % of Cu, not more than about 0.1 mass % of Sn, about 0.0005 to 0.0050 mass % of Ca, about 0.0005 to 0.0050 mass % of Mg, about 0.005 to 0.10 mass % of REM, about 0.0003 to 0.0060 mass % of B, about 0.003 to 0.03 mass % of Ti, about 0.02 to 0.20 mass % of Nb, about 0.003 to 0.03 mass % of Zr, about 0.05 to 0.5 mass % of V, and about 0.01 to 0.1 mass % of Ta.

According to still another exemplary embodiment of the present invention, a process can be provided for producing an austenitic stainless hot-rolled steel material having excellent corrosion resistance, proof stress, and low-temperature toughness, including: performing homogenizing-heat treatment on a cast steel or a semi-finished product of the austenitic stainless as described for the exemplary embodiments of the steel material above. This process can be performed at a temperature of about 1200 to 1300° C. for about 1 hour or more, reheating it at a temperature of about 1100 to 1300° C., rolling it by a draft of not less than 50% at a temperature of not lower than about 1050° C. and a draft of not less than about 10% at a temperature of about 1050 to 850° C., while maintaining a temperature of not lower than 850° C. in the rolling step, allowing an average cooling rate at about 800 to 500° C. after the rolling to be not less than about 150° C./min, and performing no solution treatment.

Exemplary embodiments of the present invention can provide austenitic stainless steel having excellent sea water resistance, proof stress, and low-temperature toughness, by restricting the component and performing a specific heat treatment processing. An austenitic stainless steel can be obtained which may be suitable for hull structures having a high level of sea water resistance and proof stress and low-temperature toughness, which are required as components for structures of high-speed ships, and contributes to industry significantly.

In a further exemplary embodiment of the present invention, an austenitic stainless hot-rolled steel material can be provided which has excellent corrosion resistance, and low-temperature toughness, including: not more than about 0.03 mass % of C, about 0.1 to 1.5 mass % of Si, about 0.1 to 3.0 mass % of Mn, not more than about 0.05 mass % of P, not more than about 0.003 mass % of 5, about 15.0 to 21.0 mass % of Ni, about 22.0 to 28.0 mass % of Cr, about 1.5 to 3.5 mass % of Mo, about 0.15 to 0.35 mass % of N, about 0.005 to 0.1 mass % of Al, and not more than about 0.007 mass % of 0, in which the PI value expressed by the following formula (1) ranges from about 35 to 40, δ cal value expressed by the following formula (2) ranges from about −6 to +4, the remnant consists of Fe and substantially inevitable impurities, and the content of intermetallic compounds contained in the steel material is not more than about 0.5 mass %, $$PI=\mathrm{Cr}+3.3(\mathrm{Mo}+0.5\mathrm{W})+16\mathrm{N} \quad (1)$$

$$\delta\ \mathrm{cal}=2.9(\mathrm{Cr}+0.3\mathrm{Si}+\mathrm{Mo}+0.5\mathrm{W})-2.6(\mathrm{Ni}+0.3\mathrm{Mn}+0.25\mathrm{Cu}+35\mathrm{C}+20\mathrm{N})-18 \quad (2)$$

in which the value by each element represents the content of the element expressed in terms of mass %.

According to still another exemplary embodiment of the present invention, the austenitic stainless hot-rolled steel material having excellent corrosion resistance can be provide, and the low-temperature toughness, as described above for other exemplary embodiments of the present invention, and further including one or more selected from the group consisting of about 0.1 to 2.0 mass % of Cu, about 0.003 to 0.03 mass % of Ti, about 0.02 to 0.20 mass % of Nb, about 0.05 to 0.5 mass % of V, about 0.3 to 3.0 mass % of W, about 0.0003 to 0.0060 mass % of B, about 0.0005 to 0.0050 mass % of Ca, about 0.0005 to 0.0050 mass % of Mg, and about 0.005 to 0.10 of REM.

According to yet another exemplary embodiment of the present invention, a process can be provided for producing the austenitic stainless hot-rolled steel material having excellent corrosion resistance, and low-temperature toughness, as set forth in the eighth or ninth aspect of the present invention, including: performing homogenizing-heat treatment on a cast steel or a semi-finished product after a rough heat-rolling processing at a temperature of 1 about 200 to 1300° C. for 1 hour or more, in order to reduce the content of the intermetallic compound in the steel material.

Exemplary embodiments of the present invention are capable of providing an austenitic stainless steel suitable for hull structures having a high level of sea water resistance and proof stress, which are preferred as components for structures of high-speed ships, and low-temperature toughness, and provides a contribution to the industry.

These and other objects, features and advantages of the present invention will become apparent upon reading the following detailed description of embodiments of the invention, when taken in conjunction with the appended claims.

DETAILED DESCRIPTION OF EXEMPLARY EMBODIMENTS OF THE INVENTION

A first exemplary embodiment of the present invention is below. As an initial matter, the characteristics preferred for structural shipping materials are described as follows. For a corrosion resistance, it is preferable to withstand sea water even without a heavy duty corrosion-resistant coating being applied thereto, and those characteristics which may be preferable to satisfy such corrosion resistance can be investigated to obtain the following results.

For example, although a usual pitting electric potential is measured in 30° C.-3.5% NaCl, the water temperature often reaches 50° C., in consideration of sea water resistance in the tropics, and further, sea water is often condensed in a gappy structure so that the NaCl concentration may increase to be higher than the 3.5% of normal sea water, and it was revealed that if the pitting electrical potential (Vc'100) measured in a deaerated 50° C.-10% NaCl aqueous solution is not less than 500 mV, then there are no significant problems in terms of practical use. Saturated Ag/AgCl can be used as a reference electrode.

With respect to the impact resistance, since it becomes problematic conversely in cold areas, it can be specified that a Charpy impact value should be not less than 100 J/cm$^2$ at −40° C., at which it can be recognized in general that no problems occur in ships.

As for hardness, it is preferably to reduce the weight. Exemplary embodiments of the present invention can provide a steel material having a high strength with a 0.2% proof stress of not less than 550 MPa at room temperature, provided that the above corrosion resistance and the impact strength are satisfied.

Further, the reason for restricting the components in the present invention are as follows. For example, the content of C can be restricted to not more than 0.03%, in order to maintain the corrosion resistance of stainless steel. If the content of C exceeds 0.03%, then Cr carbide may be generated and corrosion resistance and toughness can deteriorate. However, if the content of C is significantly reduced, then the cost for refining increases, and hence the lower limit can be specified as 0.001% (e.g., preferably, 0.01 to 0.03%).

Si may be added at not less than 0.1% for deoxidation. However, if the content of Si exceeds 1.5%, then toughness may deteriorate. Therefore, the upper limit can be specified as 1.5% (e.g., preferably 0.2 to 1.0%).

Mn is added at not less than 0.1% for deoxidation. However, if the content of Mn exceeds 3.0%, then corrosion resistance and toughness will deteriorate. Therefore, the lower limit is specified as 3.0% (e.g., preferably 0.2 to 1.5%).

P can be provided at most 0.05%, because P deteriorates the hot-rolling processability and toughness. However, if the content of P is remarkably decreased, then refining cost increases, and hence the lower limit is specified as 0.005% (e.g., preferably 0.01 to 0.03%).

S can be at most 0.003%, because S deteriorates the hot-rolling processability, toughness, and corrosion resistance. However, if the content of S is remarkably decreased, then refining cost increases, and hence the lower limit is specified as 0.0001% (e.g., preferably 0.0005 to 0.001%).

Since Ni stabilizes an austenitic configuration, and improves the corrosion resistance against various acids and toughness further, Ni is can be added at not less than about 15.0%. On the other hand, since Ni is an expensive metal, the content of Ni is restricted to not more than 21.0% from the viewpoint of cost.

Cr is contained at not less than about 22.0% in order to secure basic corrosion resistance. On the other hand, if Cr is contained at over 28.0%, then an intermetallic compound is likely to be deposited to deteriorate toughness. For this reason, the content of Cr is specified within a range of not less than 28.0% to not more than about 22.0%.

Mo is an effective element which raises the corrosion resistance of stainless steel additionally, and can be contained at not less than about 1.5% in the present invention. On the other hand, Mo is a very expensive element and Mo promotes deposition of an intermetallic compound with Cr, and hence the upper limit of Mo is specified as not more than 3.5%. Preferably the content of Mo ranges from 2.0 to 3.0%.

N is an effective element which intercrystallizes into an austenite phase to increase hardness and corrosion resistance. For this reason, N is contained at not less than 0.15%. Although N can be intercrystallized into a base material by up to 0.4%, the upper limit of the content of N is specified as about 0.35%, because N raises the sensitivity of generation of bubbling when performing welding. Preferably, the content of N can be not more than about 0.30%.

O is an important element which constitutes an oxide which represents a nonmetallic inclusion, and excessive content of O deteriorates toughness, on the other hand, if a coarse cluster-like oxide is generated, then it cause surface cracking. For this reason, the upper limit of the content of O is restricted to 0.007%. Moreover, if the content of O is significantly decreased, then the cost for refining increases, and hence the lower limit is specified to about 0.0005%. Preferably, the content of O can range from 0.001 to 0.004%.

PI value can be expressed by the above formula (1). A pitting index may be an index of corrosion resistance of stainless steel to a chloride environment, and it was possible to obtain the preferred characteristics by providing the PI value to not less than 35. As stainless steel having a PI value of more than 40, SUS836L etc. are exemplary, but the content of Ni thereof is not less than 24%, and it is expensive. According to the exemplary embodiment of the present invention, since the target is an austenitic stainless steel which has corrosion resistance corresponding to cost, the upper limit of the PI value is specified as 40. It should be noted that, in the present invention which contains no W, the value of W in formula (1) can be set to 0.

The δ cal expressed by the above formula (2) may be an index which indicates the quantity of the delta ferrite which appears in the solidified configuration of austenitic stainless steel, and in order to reduce solidification crack sensitivity or to make a configuration fine, generally it is controlled to approximately 0 to 7%. However, in steel having a high content of Cr as in the present invention, delta ferrite in a solidified configuration changes into an intermetallic compound during the hot-rolling production step, and remains in a steel material as a by-product, thereby deteriorating toughness. For this reason, the upper limit of δ cal is restricted to +2 so that delta ferrite might decrease. If δ cal exceeds this value, then it becomes difficult to obtain high toughness even when devising in the hot-rolling production step. On the other hand, the side in which δ cal is small (minus) can mean that the delta ferrite content becomes substantially 0%. As a result, the above described effect is saturated and an excess of Ni content will be contained, and hence the lower limit is restricted to −6, in view of cost. Preferably, δ cal ranges from −3 to +1. It should be noted that in the present invention without containing W and Cu, the value of W or Cu in formula (2) is set to 0.

The content of intermetallic compound which is contained in steel materials is an important factor which dictates the toughness of the austenitic stainless steel material in the exemplary embodiment of the present invention. An intermetallic compound is a compound which contains Cr, Mo, or W, as main ingredients and is known as σ phase and X phase. The content of this compound can be measured by performing alkali electrolytic etching of the micro configuration and observing it with an approximately 400-power optical microscope. It has been determined that if this content as an average value of observation of the cross-section of a steel material exceeds 0.5%, then Charpy absorbed energy of the steel material becomes less than 100 J/cm$^2$, and specified the upper limit thereof to be 0.5%.

The second exemplary embodiment of the present invention is described as follows.

W is an element which raises the corrosion resistance of stainless steel additionally as well as Mo, and W can be contained by an amount ranging from 0.3 to 3.0% in the exemplary embodiment of the present invention steel for this purpose.

Al is an important element for deoxidation of steel, and in order to reduce oxygen in steel, Al is contained by at amount of not less than 0.005%. On the other hand, Al is an element having a relatively large affinity to N, and hence if an excess of Al is added, then AlN is generated to deteriorate the toughness of stainless steel. Although the degree of deterioration of toughness depends on the N content, if the Al content exceeds 0.1%, then the toughness deteriorates significantly, and hence the upper limit of Al content is specified as 0.1%.

The third exemplary embodiment of the present invention is described as follows

Cu is an element which raises the corrosion resistance of stainless steel against an acid additionally, and Cu can be contained for this purpose. It is preferable to add Cu in an amount of not less than 0.3%, whereas if Cu in an amount of more than 2.0% is added, the effect in line with the cost is saturated, and hence the upper limit is specified as 2.0%.

Although Sn also raises the corrosion resistance of steel, an excess of Sn causes hot-rolling processing cracking, and hence the upper limit is specified as 0.1%. Preferably, the lower limit of Sn content is specified as 0.005%.

The fourth exemplary embodiment of the present invention is described as follows Each of Ca, Mg, and REM(s) is an element which improves the hot-rolling processability of steel, and one or more of them are added for this purpose. Excessive addition of each of them deteriorates the hot-rolling processability adversely, and hence the upper limit and the lower limit thereof are specified as follows. That is, the content of each of Ca and Mg ranges from 0.0005 to 0.0050%, and the content of REM ranges from 0.005 to 0.10%. Here, REM represents the total content of a lanthanide series rare-earth element such as La, Ce, etc.

Furthermore, the PV value specified by the following formula (3) is set to be not more than 0. This formula is one that clarifies the required amount Ca, Mg, and REM to be added based on the existing amount of S, and it is possible to add exactly by making the PV value to be not more than 0, thereby improving the hot-rolling processability further.

$$PV=S+O-0.8Ca-0.3Mg-0.3REM-30 \quad (3)$$

The fifth exemplary embodiment of the present invention is described as follows

As for B, by adding it in an amount of not less than 0.0003%, it becomes possible to increase grain boundary strength and improve the hot-rolling processability. However, since excessive addition of B deteriorates the hot-rolling processability to the contrary due to an excessively deposited boride, the upper limit of the B content is specified as 0.0060%.

The sixth exemplary embodiment of the present invention is described as follows

Ti is an element which forms an oxide, a nitride, and sulfide with a very small amount thereof, and makes the crystal grain of steel fine, and Ti is an element which can be advantageously used in the steel material of the present invention. In order to reduce the intermetallic compound content in steel materials, it is effective to restrict the upper limit value of δ cal and perform homogenizing heat treatment of semi-finished products, Among these, in the latter method, heat treatment at a high temperature of approximately 1250° C. can be performed for several hours, if a proper amount of Ti is contained therein, then growth of crystal grain during the heat treatment at a high temperature as such can be effectively suppressed. For this purpose, it is necessary to add Ti in an amount of not less than 0.003%. On the other hand, Ti is an element which has a high nitride-forming power, and hence if Ti in an amount of over 0.03% is contained in the steel material of the present invention which contains N, then coarse TiN will deteriorate the toughness of the steel. For this reason, Ti content is specified in the range of 0.003 to 0.03%. Preferably, the Ti content can have a range from 0.005 to 0.02%, in the case in which Ti is contained.

Nb forms carbide to fix C, thereby suppressing formation of Cr carbide to increase corrosion resistance and toughness. In addition, Nb forms nitride to suppress the growth of crystal grain, thereby converting steel material into fine grains to increase the strength. For improving corrosion resistance and increasing strength, Nb in an amount of not less than 0.02% can be contained. However, if Nb in an amount of over 0.2% is added, then a large amount of carbon nitride of Nb is deposited during the hot-rolling processing step to deteriorate the hot-rolling recrystallization and a coarse configuration will remain in a steel material as a product, and hence the upper limit of Nb content is specified as 0.2%. Preferably Nb content can have a range from 0.05% to 0.15%.

V is an element that forms a carbon nitride as well as Nb, and V can be added in order to maintain corrosion resistance and toughness. Although V is contained in an amount of not less than 0.05% for this purpose, if V in an amount of over 0.5% is contained, then a coarse V series carbon nitride will be generated, and toughness will deteriorate conversely. Therefore, the upper limit of V is restricted to 0.5% (e.g., preferably from 0.1 to 0.3%).

Although Zr and Ta can inhibit the negative influence on the corrosion resistance of C or S by addition, if Zr or Ta is added excessively, then deterioration of toughness will occur, and hence Zr content is restricted to 0.003 to 0.03% and Ta content can be provided at 0.01 to 0.1%.

The seventh exemplary embodiment of the present invention is described as follows In order to increase the toughness of steel materials in the present invention, the amount of intermetallic compound contained in the steel material is restricted to not more than 0.5%, however, solidifying heat treatment after the final heat-rolling step must be omitted in order to obtain high proof stress. Therefore, as for an intermetallic compound, it is necessary to reduce the intermetallic compound contained in a cast steel, and to prevent formation of the intermetallic compound during the hot-roiling step as far as possible.

First, as the technique for reducing the intermetallic compound in the cast steel, it is preferable to combine the controlling of δ cal with the homogenizing heat treatment to the cast steel of steel described in this exemplary embodiment. In the case in which there is no solidification segregation in the target steel materials of the present invention, the temperature at which an intermetallic compound is generated is approximately not higher than 1000° C. However, in the semi-finished product which is accompanied with segregation of ingredients caused by solidification, it becomes necessary to perform a production step for diffusing the segregation and homogenizing it in order to reduce the content of an intermetallic compound in the semi-finished product. Although the temperature and the time of this homogenizing heat treatment can change slightly, corresponding to chemical composition such as solidifying rate and cross-sectional area of the cast steel, the degree of hot-rolling processing when processing into a semi-finished product, and δ cal, etc., the temperature required is not lower than 1200° C., because the rate is limited by diffusion of Cr, Mo, Ni, etc. On the other hand, if the temperature exceeds 1300° C., then oxidized scale may be generated more than usually As for the time, it is preferable that the time be as long as possible, and at least one hour is necessary. Moreover, this purpose can be attained by performing a soaking at 1200° C. for one hour or more during heating of the semi-finished product for rolling a product. As mentioned above, it is specified to perform homogenizing heat treatment for one hour or more at a temperature ranging from 1200 to 1300° C. Taking the effect and the economical efficiency into consideration, a preferable range of soaking time ranges from 2 to 20 hours.

As for the rolling condition, it consists of the rough rolling stage in which re-heating is performed at a temperature ranging from 1100 to 1300° C. and making the total compaction amount at a temperature of not lower than 1050° C. to be not less than 50%, and the successive finishing rolling stage in which the total compaction amount at a temperature ranging from 1050 to 850° C. is made to be not less than 10%. The rough rolling stage is a stage in which the solidification structure is mainly destroyed, to obtain a uniform recrystallized structure, whereas the finishing rolling step is a step of introducing the processing strain by the rolling and for increasing the strength after the rolling processing. In addition, all of the rolling processing is performed at a temperature of not lower than 850° C., thereby preventing the re-deposition of the intermetallic compound. Further, a controlled cooling is performed at an average cooling rate of not less than 150° C./min from 800 to 500° C. after the rolling processing, thereby inhibiting the re-deposition of the intermetallic compound and the recovery of the processing strain which was introduced in the finishing rolling step.

The exemplary reason for restricting the condition is described in further detail below. In order to make it possible to perform a rolling processing which makes the total compaction amount to be not less than 50% at a temperature of not lower than 1050° C., to reduce deformation resistance, and to make it easy to perform the rolling processing, it is necessary to heat the steel ingot to not lower than 1100° C. However, if it is heated over 1300° C., then the grain boundary will be fused to cause cracks during the hot-rolled processing, and hence the heating temperature is restricted to be within a range of 1100 to 1300° C.

In the rough rolling stage, in order to destroy the solidification structure and to obtain a uniform recrystallized structure, it is necessary to make the total compaction amount at a temperature of not lower than 1050° C. to be not less than 50%. If the rolling temperature is lower than 1050° C. or the total compaction amount is less than 50%, then it is not possible to obtain uniform recrystallized structure.

In the finishing rolling stage, in order to acquire the target proof stress of 550 MPa, it is necessary to perform a finishing rolling by which the total compaction amount at a temperature of 1050° C. to 850° C. in the component range which is restricted in the present invention should be not less than 10%. In addition, if a rolling processing is performed at a temperature over 1050° C., then recrystallization will occur, and as a result compressing strain cannot be accumulated, so that sufficient strength cannot be obtained, whereas if a rolling processing is performed at a temperature lower than 850° C., then deposition of the intermetallic compound will be promoted to deteriorate toughness remarkably. Therefore, it is preferable to perform the rolling processing during all of the rolling processing, while maintaining the temperature to be not lower than 850° C. Finally, high hardness can be maintained by omitting solution heat treatment.

Example 1

The chemical constitution of a test piece of steel is shown in Table 1. It should be noted that, the content of inevitable impurity elements other than the components indicated in Table 1 is the same level as in standard stainless steel. Moreover, as to the portions where no contents are shown for the components shown in Table 1, this means that the content is the same level as in an impurity level. Moreover, REM in the Tables represents lanthanoid series rare earth elements, and the content indicates the total of these elements. These steel samples were melted in a 50 kg-vacuum induction furnace in a laboratory and east into a flat steel ingot having a thickness of approximately 100 mm.

TABLE 1

| STEEL No. | | C | Si | Mn | P | S | Ni | Cr | Mo | Cu |
|---|---|---|---|---|---|---|---|---|---|---|
| A | EXAMPLE 1 | 0.021 | 0.49 | 0.48 | 0.020 | 0.0005 | 17.91 | 25.15 | 2.31 | 0.12 |
| B | EXAMPLE 1 | 0.019 | 0.46 | 0.32 | 0.023 | 0.0003 | 18.23 | 24.65 | 2.46 | 0.21 |
| C | EXAMPLE 2 | 0.018 | 0.52 | 0.52 | 0.014 | 0.0005 | 17.98 | 25.02 | 2.46 | 0.05 |

TABLE 1-continued

| | | | | | | | | | | |
|---|---|---|---|---|---|---|---|---|---|---|
| D | EXAMPLE 3 | 0.022 | 0.49 | 0.52 | 0.022 | 0.0006 | 18.43 | 24.88 | 2.46 | 0.45 |
| E | EXAMPLE 3 | 0.015 | 0.71 | 1.71 | 0.026 | 0.0002 | 19.25 | 26.35 | 1.92 | 0.22 |
| F | EXAMPLE 4 | 0.021 | 0.48 | 0.52 | 0.022 | 0.0009 | 18.25 | 25.36 | 2.53 | 0.30 |
| G | EXAMPLE 4 | 0.022 | 0.46 | 0.52 | 0.021 | 0.0008 | 20.21 | 24.96 | 2.46 | 0.31 |
| H | EXAMPLE 4 | 0.022 | 0.48 | 0.49 | 0.022 | 0.0003 | 19.23 | 24.64 | 3.33 | 0.28 |
| I | EXAMPLE 5 | 0.021 | 0.47 | 0.52 | 0.022 | 0.0007 | 18.33 | 24.66 | 2.48 | 0.32 |
| J | EXAMPLE 6 | 0.019 | 0.45 | 0.53 | 0.023 | 0.0008 | 18.23 | 24.65 | 2.46 | 0.32 |
| K | EXAMPLE 6 | 0.019 | 0.49 | 0.49 | 0.022 | 0.0004 | 20.42 | 27.31 | 1.68 | 0.31 |
| L | EXAMPLE 6 | 0.024 | 0.49 | 0.49 | 0.021 | 0.0003 | 19.53 | 24.61 | 2.11 | 1.82 |
| M | EXAMPLE 6 | 0.019 | 0.49 | 0.85 | 0.019 | 0.0013 | 18.89 | 25.29 | 2.52 | 0.32 |
| N | EXAMPLE 6 | 0.021 | 0.50 | 0.84 | 0.019 | 0.0005 | 16.77 | 25.21 | 2.10 | 0.85 |
| a | COMPARATIVE EXAMPLE | 0.035 | 0.35 | 0.25 | 0.008 | 0.0009 | 17.91 | 24.68 | 2.35 | 0.21 |
| b | COMPARATIVE EXAMPLE | 0.006 | 1.75 | 2.11 | 0.027 | 0.0006 | 18.93 | 24.67 | 2.64 | 0.06 |
| c | COMPARATIVE EXAMPLE | 0.025 | 0.44 | 3.31 | 0.018 | 0.0010 | 17.59 | 27.19 | 1.65 | 0.58 |
| d | COMPARATIVE EXAMPLE | 0.018 | 0.51 | 0.51 | 0.055 | 0.0003 | 18.21 | 23.77 | 2.33 | 0.91 |
| e | COMPARATIVE EXAMPLE | 0.017 | 0.40 | 0.55 | 0.012 | 0.0033 | 17.64 | 24.21 | 2.58 | 1.22 |
| f | COMPARATIVE EXAMPLE | 0.022 | 0.36 | 0.61 | 0.026 | 0.0008 | 14.55 | 22.91 | 2.53 | 0.46 |
| g | COMPARATIVE EXAMPLE | 0.008 | 0.33 | 1.21 | 0.013 | 0.0006 | 20.12 | 27.55 | 1.22 | 0.25 |
| h | COMPARATIVE EXAMPLE | 0.028 | 0.53 | 0.43 | 0.022 | 0.0006 | 18.88 | 22.84 | 3.68 | 0.66 |
| i | COMPARATIVE EXAMPLE | 0.033 | 0.15 | 0.35 | 0.026 | 0.0004 | 20.55 | 25.35 | 2.33 | 0.24 |
| j | COMPARATIVE EXAMPLE | 0.022 | 0.47 | 0.53 | 0.025 | 0.0008 | 18.21 | 24.96 | 2.46 | 0.33 |
| k | COMPARATIVE EXAMPLE | 0.021 | 0.26 | 1.85 | 0.022 | 0.0009 | 15.61 | 21.89 | 2.12 | 0.31 |
| l | COMPARATIVE EXAMPLE | 0.021 | 0.48 | 0.51 | 0.024 | 0.0007 | 18.55 | 28.22 | 2.01 | 0.31 |
| m | COMPARATIVE EXAMPLE | 0.022 | 0.49 | 0.52 | 0.023 | 0.0008 | 21.40 | 24.95 | 2.47 | 0.33 |
| n | COMPARATIVE EXAMPLE | 0.024 | 0.45 | 0.52 | 0.024 | 0.0006 | 18.22 | 24.94 | 2.47 | 0.31 |
| o | COMPARATIVE EXAMPLE | 0.022 | 0.51 | 0.18 | 0.037 | 0.0028 | 19.56 | 25.61 | 2.64 | 0.35 |
| p | COMPARATIVE EXAMPLE | 0.019 | 0.53 | 0.46 | 0.021 | 0.0003 | 18.36 | 24.91 | 2.28 | 0.36 |
| q | COMPARATIVE EXAMPLE | 0.018 | 0.56 | 0.53 | 0.021 | 0.0006 | 16.95 | 22.21 | 3.39 | 1.66 |
| r | COMPARATIVE EXAMPLE | 0.026 | 1.22 | 0.66 | 0.016 | 0.0003 | 17.91 | 23.96 | 2.31 | 0.33 |
| s | COMPARATIVE EXAMPLE | 0.021 | 0.48 | 0.53 | 0.023 | 0.0008 | 18.23 | 24.89 | 2.46 | 0.32 |
| t | COMPARATIVE EXAMPLE | 0.022 | 0.47 | 0.54 | 0.024 | 0.0007 | 18.33 | 23.33 | 2.45 | 0.35 |
| u | COMPARATIVE EXAMPLE | 0.023 | 0.46 | 0.55 | 0.023 | 0.0008 | 18.25 | 24.98 | 2.48 | 0.32 |
| v | COMPARATIVE EXAMPLE | 0.013 | 0.48 | 1.21 | 0.013 | 0.0005 | 16.36 | 22.64 | 2.93 | 0.28 |
| w | COMPARATIVE EXAMPLE | 0.024 | 0.55 | 0.78 | 0.019 | 0.0005 | 17.21 | 23.51 | 2.33 | 0.33 |

| STEEL No. | | Cu | Sn | Nb | Ti | V | Zr | Ta | W | Al |
|---|---|---|---|---|---|---|---|---|---|---|
| A | EXAMPLE 1 | 0.12 | | | | | | | | |
| B | EXAMPLE 1 | 0.21 | | | | | | | 1.05 | |
| C | EXAMPLE 2 | 0.05 | | | | | | | | 0.018 |
| D | EXAMPLE 3 | 0.45 | | | | | | | | 0.032 |
| E | EXAMPLE 3 | 0.22 | 0.08 | | | | | | | 0.051 |
| F | EXAMPLE 4 | 0.30 | | | | | | | | 0.026 |
| G | EXAMPLE 4 | 0.31 | | | | | | | 0.71 | 0.028 |
| H | EXAMPLE 4 | 0.28 | | | | | | | | 0.034 |
| I | EXAMPLE 5 | 0.32 | | | | | | | | 0.022 |
| J | EXAMPLE 6 | 0.32 | | | 0.012 | | | | | 0.023 |
| K | EXAMPLE 6 | 0.31 | | 0.121 | | | | | | 0.011 |
| L | EXAMPLE 6 | 1.82 | | | | 0.28 | | | 2.10 | 0.023 |
| M | EXAMPLE 6 | 0.32 | | | | | 0.021 | | | 0.020 |
| N | EXAMPLE 6 | 0.85 | | | | | | 0.035 | | 0.018 |
| a | COMPARATIVE EXAMPLE | 0.21 | | | | | | | | |
| b | COMPARATIVE EXAMPLE | 0.06 | | | | | | | | 0.009 |
| c | COMPARATIVE EXAMPLE | 0.58 | | | | | | | | |

TABLE 1-continued

| | | | | | | | | | | |
|---|---|---|---|---|---|---|---|---|---|---|
| d | COMPARATIVE EXAMPLE | 0.91 | | | | | | | | 0.012 |
| e | COMPARATIVE EXAMPLE | 1.22 | | | 0.006 | | | | | 0.061 |
| f | COMPARATIVE EXAMPLE | 0.46 | | 0.111 | | | | | | |
| g | COMPARATIVE EXAMPLE | 0.25 | | | | | | | | |
| h | COMPARATIVE EXAMPLE | 0.66 | | | | | | | 1.35 | |
| i | COMPARATIVE EXAMPLE | 0.24 | | | | | | | | 0.035 |
| j | COMPARATIVE EXAMPLE | 0.33 | | | 0.014 | | | | | 0.002 |
| k | COMPARATIVE EXAMPLE | 0.31 | | 0.075 | | | | | | 0.020 |
| l | COMPARATIVE EXAMPLE | 0.31 | | | | | | | | |
| m | COMPARATIVE EXAMPLE | 0.33 | | | | | | | | 0.026 |
| n | COMPARATIVE EXAMPLE | 0.31 | | | | | | | | 0.140 |
| o | COMPARATIVE EXAMPLE | 0.35 | 0.05 | | | | | | 0.65 | |
| p | COMPARATIVE EXAMPLE | 0.36 | | | | | | | | 0.033 |
| q | COMPARATIVE EXAMPLE | 1.66 | | | | | | | | 0.024 |
| r | COMPARATIVE EXAMPLE | 0.33 | | | | | | | | |
| s | COMPARATIVE EXAMPLE | 0.32 | | | 0.046 | | | | | 0.026 |
| t | COMPARATIVE EXAMPLE | 0.35 | | 0.284 | | | | | 1.11 | 0.026 |
| u | COMPARATIVE EXAMPLE | 0.32 | | | | 0.88 | | | | 0.024 |
| v | COMPARATIVE EXAMPLE | 0.28 | | | | | 0.037 | | | |
| w | COMPARATIVE EXAMPLE | 0.33 | | | | | | 0.12 | | 0.064 |

| STEEL No. | | B | Ca | Mg | REM | O | N | δ cal | PI | PV |
|---|---|---|---|---|---|---|---|---|---|---|
| A | EXAMPLE 1 | | | | | 0.0055 | 0.235 | 0.9 | 36.5 | 30.0 |
| B | EXAMPLE 1 | | | | | 0.0063 | 0.266 | −0.8 | 38.8 | 36.0 |
| C | EXAMPLE 2 | | | | | 0.0041 | 0.266 | −0.5 | 37.4 | 16.0 |
| D | EXAMPLE 3 | | | | | 0.0025 | 0.240 | −1.4 | 36.8 | 1.0 |
| E | EXAMPLE 3 | | | | | 0.0030 | 0.281 | −2.9 | 37.2 | 2.0 |
| F | EXAMPLE 4 | | 0.0022 | | | 0.0035 | 0.238 | 1.0 | 37.5 | −3.6 |
| G | EXAMPLE 4 | | | 0.0033 | | 0.0025 | 0.242 | −4.8 | 38.1 | −6.9 |
| H | EXAMPLE 4 | | | | 0.009 | 0.0019 | 0.257 | −2.4 | 39.7 | −35.0 |
| I | EXAMPLE 5 | 0.0033 | | | | 0.0026 | 0.235 | −1.3 | 36.6 | 3.0 |
| J | EXAMPLE 6 | | 0.0008 | 0.0033 | | 0.0035 | 0.247 | −1.6 | 36.7 | −3.3 |
| K | EXAMPLE 6 | | 0.0023 | | | 0.0036 | 0.245 | −1.6 | 36.8 | −8.4 |
| L | EXAMPLE 6 | | 0.0020 | | | 0.0025 | 0.173 | −0.6 | 37.8 | −18.0 |
| M | EXAMPLE 6 | | 0.0008 | | 0.021 | 0.0040 | 0.235 | −0.9 | 37.4 | −46.4 |
| N | EXAMPLE 6 | | 0.0042 | | | 0.0020 | 0.315 | −1.5 | 37.2 | −38.6 |
| a | COMPARATIVE EXAMPLE | | | | | 0.0022 | 0.193 | 0.6 | 35.5 | 1.0 |
| b | COMPARATIVE EXAMPLE | | 0.0006 | | | 0.0034 | 0.264 | −2.5 | 37.6 | 5.2 |
| c | COMPARATIVE EXAMPLE | 0.0009 | | | | 0.0022 | 0.252 | 1.9 | 36.7 | 2.0 |
| d | COMPARATIVE EXAMPLE | | | 0.0008 | | 0.0028 | 0.265 | −5.6 | 35.7 | −1.4 |
| e | COMPARATIVE EXAMPLE | | 0.0012 | | | 0.0009 | 0.237 | −0.9 | 36.5 | 2.4 |
| f | COMPARATIVE EXAMPLE | 0.0028 | | 0.0022 | | 0.0026 | 0.279 | 1.0 | 35.7 | −2.6 |
| g | COMPARATIVE EXAMPLE | | | | | 0.0026 | 0.295 | −3.8 | 36.3 | 2.0 |
| h | COMPARATIVE EXAMPLE | | | | | 0.0034 | 0.155 | 0.9 | 39.7 | 10.0 |
| i | COMPARATIVE EXAMPLE | | | | 0.035 | 0.0052 | 0.121 | −0.8 | 35.0 | −79.0 |
| j | COMPARATIVE EXAMPLE | | 0.0036 | | | 0.0081 | 0.242 | −0.6 | 37.0 | 30.2 |
| k | COMPARATIVE EXAMPLE | | 0.0019 | 0.0008 | | 0.0032 | 0.184 | −1.9 | 31.8 | −6.6 |

TABLE 1-continued

| | | | | | | | | | | |
|---|---|---|---|---|---|---|---|---|---|---|
| l | COMPARATIVE EXAMPLE | | 0.0022 | | | 0.0029 | 0.271 | 5.3 | 39.2 | −11.6 |
| m | COMPARATIVE EXAMPLE | | 0.0023 | | | 0.0030 | 0.240 | −8.8 | 36.9 | −10.4 |
| n | COMPARATIVE EXAMPLE | | 0.0024 | | | 0.0032 | 0.235 | −0.5 | 36.9 | −11.2 |
| o | COMPARATIVE EXAMPLE | | 0.0067 | | | 0.0032 | 0.222 | 0.5 | 38.9 | −23.6 |
| p | COMPARATIVE EXAMPLE | | | 0.0071 | | 0.0032 | 0.262 | −2.4 | 36.6 | −16.3 |
| q | COMPARATIVE EXAMPLE | | 0.0030 | | 0.111 | 0.0032 | 0.212 | −1.5 | 36.8 | −349.0 |
| r | COMPARATIVE EXAMPLE | 0.0071 | | | | 0.0032 | 0.222 | −2.0 | 35.1 | 5.0 |
| s | COMPARATIVE EXAMPLE | | 0.0025 | | | 0.0032 | 0.241 | −0.7 | 36.9 | −10.0 |
| t | COMPARATIVE EXAMPLE | | 0.0026 | | 0.015 | 0.0033 | 0.173 | −0.5 | 36.0 | −55.8 |
| u | COMPARATIVE EXAMPLE | | 0.0025 | | | 0.0031 | 0.239 | −0.6 | 37.0 | −11.0 |
| v | COMPARATIVE EXAMPLE | | | 0.0025 | | 0.0030 | 0.263 | −2.0 | 36.5 | −2.5 |
| w | COMPARATIVE EXAMPLE | | | | | 0.0025 | 0.245 | −3.1 | 35.1 | 0.0 |

____: VALUE WITHOUT THE RANGE OF THE PRESENT INVENTION

A steel sheet having a thickness ranging from 12 to 22 mm was produced by performing cogging, homogenizing heat treatment, and product rolling, using the above sample steel. In the cogging, the sample steel was soaked at 1180° C. for two hours, and thereafter the sample steel was rolled to 65 mm thickness. Then the resultant semi-finished products were subjected to homogenizing heat treatment under the conditions shown in Tables 2 and 3. Some of the semi-finished products were not subjected to the homogenizing heat treatment. Each piece of steel was ground to 60 mm to obtain the material for use in product rolling, and thereafter the resultant material for use in product rolling was subjected to hot-rolling processing to obtain a hot-rolled steel material. It should be noted that the steel material immediately after being hot-rolled which was in a temperature state of not less than 800° C. was cooled to a temperature of not higher than 500° C. by performing spray cooling. Some of the steel sheets were subjected to a solution heat treatment under the condition of 1100° C.×20 min with cooling by water, after soaking.

TABLE 2

| No. | STEEL No. | | INTERMETALLIC COMPOUND CONTENT (%) | HOMOGENIZING HEAT TREATMENT | RE-HEATING TEMPERATURE (° C.) | REDUCTION AT 1050° C. OR MORE (%) | REDUCTION AT A TEMPERATURE OF 1050 TO 850° C. (%) |
|---|---|---|---|---|---|---|---|
| 1 | A | EXAMPLE | 0.35 | 1250° C. × 4 h | 1200 | 60 | 20 |
| 2 | B | EXAMPLE | 0.05 | 1250° C. × 4 h | 1200 | 60 | 20 |
| 3 | C | EXAMPLE | 0.10 | 1250° C. × 4 h | 1200 | 60 | 20 |
| 4 | D | EXAMPLE | 0.20 | 1250° C. × 4 h | 1200 | 60 | 20 |
| 5 | E | EXAMPLE | 0.05 | 1250° C. × 4 h | 1200 | 60 | 20 |
| 6 | F | EXAMPLE | 0.30 | 1250° C. × 4 h | 1200 | 60 | 20 |
| 7 | F | EXAMPLE | 0.35 | 1220° C. × 2 h | 1200 | 60 | 20 |
| 8 | F | EXAMPLE | 0.25 | 1200° C. × 20 h | 1200 | 60 | 20 |
| 9 | F | EXAMPLE | 0.40 | 1250° C. × 4 h | 1250 | 60 | 20 |
| 10 | F | EXAMPLE | 0.30 | 1250° C. × 4 h | 1200 | 75 | 15 |
| 11 | F | EXAMPLE | 0.30 | 1250° C. × 4 h | 1200 | 60 | 12 |
| 12 | F | COMPARATIVE EXAMPLE | 0.95 | UNDONE | 1200 | 60 | 20 |
| 13 | F | COMPARATIVE EXAMPLE | 0.75 | 1150°C. ×5 h | 1200 | 60 | 20 |
| 14 | F | COMPARATIVE EXAMPLE | 0.80 | 1200°C. ×15 m | 1200 | 60 | 20 |
| 15 | F | COMPARATIVE EXAMPLE | 0.45 | 1250° C. × 4 h | 1050 | 0 | 68 |
| 16 | F | COMPARATIVE EXAMPLE | 0.35 | 1250° C. × 4 h | 1200 | 60 | 7 |
| 17 | F | COMPARATIVE EXAMPLE | 0.60 | 1250° C. × 4 h | 1200 | 60 | 20 |
| 18 | F | COMPARATIVE EXAMPLE | 0.85 | 1250° C. × 4 h | 1200 | 60 | 20 |
| 19 | F | COMPARATIVE EXAMPLE | 0.00 | 1250° C. × 4 h | 1200 | 60 | 20 |
| 20 | G | EXAMPLE | 0.20 | 1250° C. × 4 h | 1200 | 60 | 5 |
| 21 | H | EXAMPLE | 0.25 | 1250° C. × 4 h | 1200 | 60 | 20 |
| 22 | I | EXAMPLE | 0.30 | 1250° C. × 4 h | 1200 | 60 | 20 |
| 23 | J | EXAMPLE | 0.20 | 1250° C. × 4 h | 1200 | 60 | 20 |

TABLE 2-continued

| No. | STEEL No. | | ROLLING FINISHING TEMPERATURE (° C.) | COOLING RATE AT A TEMPERATURE OF 800 TO 500° C. (° C./min) | SOLUTION HEAT TREATMENT | EAR CRACK (mm) | PROOF STRESS (MPa) | vE − 40° C. (J/cm$^2$) | Vc' 100 (mV vs Saturated Ag/AgCl) |
|---|---|---|---|---|---|---|---|---|---|
| 1 | A | EXAMPLE | 900 | 250 | UNDONE | 5 | 710 | 130 | 630 |
| 2 | B | EXAMPLE | 900 | 250 | UNDONE | 8 | 730 | 147 | 750 |
| 3 | C | EXAMPLE | 900 | 250 | UNDONE | 5 | 726 | 187 | 700 |
| 4 | D | EXAMPLE | 900 | 250 | UNDONE | 3 | 711 | 201 | 685 |
| 5 | E | EXAMPLE | 900 | 250 | UNDONE | 5 | 733 | 203 | 705 |
| 6 | F | EXAMPLE | 900 | 250 | UNDONE | 0 | 713 | 199 | 720 |
| 7 | F | EXAMPLE | 900 | 250 | UNDONE | 0 | 720 | 167 | 715 |
| 8 | F | EXAMPLE | 900 | 250 | UNDONE | 0 | 710 | 195 | 720 |
| 9 | F | EXAMPLE | 900 | 250 | UNDONE | 0 | 706 | 163 | 710 |
| 10 | F | EXAMPLE | 900 | 250 | UNDONE | 0 | 716 | 200 | 710 |
| 11 | F | EXAMPLE | 900 | 250 | UNDONE | 0 | 590 | 225 | 725 |
| 12 | F | COMPARATIVE EXAMPLE | 900 | 250 | UNDONE | 0 | 729 | 63 | 625 |
| 13 | F | COMPARATIVE EXAMPLE | 900 | 250 | UNDONE | 0 | 724 | 74 | 645 |
| 14 | F | COMPARATIVE EXAMPLE | 900 | 250 | UNDONE | 0 | 725 | 66 | 630 |
| 15 | F | COMPARATIVE EXAMPLE | 900 | 250 | UNDONE | 0 | 735 | 70 | 685 |
| 16 | F | COMPARATIVE EXAMPLE | 900 | 250 | UNDONE | 0 | 538 | 281 | 730 |
| 17 | F | COMPARATIVE EXAMPLE | 800 | 250 | UNDONE | 0 | 730 | 55 | 550 |
| 18 | F | COMPARATIVE EXAMPLE | 900 | 75 | UNDONE | 0 | 716 | 57 | 535 |
| 19 | F | COMPARATIVE EXAMPLE | 900 | 250 | DONE | 0 | 345 | 350 | 780 |
| 20 | G | EXAMPLE | 900 | 250 | UNDONE | 0 | 725 | 202 | 740 |
| 21 | H | EXAMPLE | 900 | 250 | UNDONE | 0 | 724 | 217 | 775 |
| 22 | I | EXAMPLE | 900 | 250 | UNDONE | 0 | 712 | 193 | 645 |
| 23 | J | EXAMPLE | 900 | 250 | UNDONE | 0 | 729 | 164 | 680 |

____: VALUE WITHOUT THE RANGE OF THE PRESENT INVENTION

TABLE 3

| No. | STEEL No. | | INTERMETALLIC COMPOUND CONTENT (%) | HOMOGENIZING HEAT TREATMENT | RE-HEATING TEMPERATURE (° C.) | REDUCTION AT 1050° C. OR MORE (%) | REDUCTION AT A TEMPERATURE OF 1050 TO 850° C. (%) |
|---|---|---|---|---|---|---|---|
| 24 | K | EXAMPLE | 0.15 | 1250° C. × 4 h | 1200 | 60 | 20 |
| 25 | K | EXAMPLE | 0.20 | 1250° C. × 4 h | 1200 | 60 | 35 |
| 26 | K | EXAMPLE | 0.30 | 1250° C. × 4 h | 1200 | 60 | 20 |
| 27 | K | EXAMPLE | 0.05 | 1250° C. × 4 h | 1200 | 60 | 20 |
| 28 | K | EXAMPLE | 0.05 | 1250° C. × 4 h | 1200 | 60 | 20 |
| 29 | K | COMPARATIVE EXAMPLE | 1.00 | UNDONE | 1200 | 60 | 20 |
| 30 | K | COMPARATIVE EXAMPLE | 0.70 | 1150°C. ×5 h | 1200 | 60 | 20 |
| 31 | K | COMPARATIVE EXAMPLE | 0.70 | 1200°C. ×15 m | 1200 | 60 | 20 |
| 32 | K | COMPARATIVE EXAMPLE | 0.45 | 1250° C. × 4 h | 1350 | 60 | 20 |
| 33 | K | COMPARATIVE EXAMPLE | 0.40 | 1250° C. × 4 h | 1050 | 0 | 68 |
| 34 | K | COMPARATIVE EXAMPLE | 0.30 | 1250° C. × 4 h | 1200 | 60 | 7 |
| 35 | K | COMPARATIVE EXAMPLE | 0.75 | 1250° C. × 4 h | 1200 | 60 | 20 |
| 36 | K | COMPARATIVE EXAMPLE | 0.75 | 1250° C. × 4 h | 1200 | 60 | 20 |
| 37 | K | COMPARATIVE EXAMPLE | 0.00 | 1250° C. × 4 h | 1200 | 60 | 20 |
| 38 | L | EXAMPLE | 0.30 | 1250° C. × 4 h | 1200 | 60 | 20 |
| 39 | M | EXAMPLE | 0.35 | 1250° C. × 4 h | 1200 | 60 | 20 |
| 40 | N | EXAMPLE | 0.25 | 1250° C. × 4 h | 1200 | 60 | 20 |

TABLE 3-continued

| No. | STEEL No. | | ROLLING FINISHING TEMPERATURE (° C.) | COOLING RATE AT A TEMPERATURE OF 800 TO 500° C. (° C./min) | SOLUTION HEAT TREATMENT | EAR CRACK (mm) | PROOF STRESS (MPa) | vE − 40° C. (J/cm$^2$) | Vc' 100 (mV vs Saturated Ag/AgCl) |
|---|---|---|---|---|---|---|---|---|---|
| 24 | K | EXAMPLE | 900 | 250 | UNDONE | 0 | 740 | 183 | 700 |
| 25 | K | EXAMPLE | 900 | 250 | UNDONE | 0 | 745 | 182 | 695 |
| 26 | K | EXAMPLE | 860 | 250 | UNDONE | 0 | 751 | 167 | 695 |
| 27 | K | EXAMPLE | 970 | 250 | UNDONE | 0 | 723 | 197 | 700 |
| 28 | K | EXAMPLE | 900 | 500 | UNDONE | 0 | 741 | 193 | 715 |
| 29 | K | COMPARATIVE EXAMPLE | 900 | 250 | UNDONE | 0 | 743 | 53 | 645 |
| 30 | K | COMPARATIVE EXAMPLE | 900 | 250 | UNDONE | 0 | 741 | 60 | 655 |
| 31 | K | COMPARATIVE EXAMPLE | 900 | 250 | UNDONE | 0 | 740 | 63 | 655 |
| 32 | K | COMPARATIVE EXAMPLE | 900 | 250 | UNDONE | 70 | 720 | 95 | 605 |
| 33 | K | COMPARATIVE EXAMPLE | 900 | 250 | UNDONE | 0 | 755 | 66 | 705 |
| 34 | K | COMPARATIVE EXAMPLE | 900 | 250 | UNDONE | 0 | 545 | 270 | 715 |
| 35 | K | COMPARATIVE EXAMPLE | 800 | 250 | UNDONE | 0 | 752 | 52 | 585 |
| 36 | K | COMPARATIVE EXAMPLE | 900 | 75 | UNDONE | 0 | 743 | 47 | 570 |
| 37 | K | COMPARATIVE EXAMPLE | 900 | 250 | DONE | 0 | 358 | 304 | 815 |
| 38 | L | EXAMPLE | 900 | 250 | UNDONE | 0 | 652 | 197 | 735 |
| 39 | M | EXAMPLE | 900 | 250 | UNDONE | 0 | 700 | 191 | 720 |
| 40 | N | EXAMPLE | 900 | 250 | UNDONE | 0 | 758 | 183 | 645 |

____: VALUE WITHOUT THE RANGE OF THE PRESENT INVENTION

TABLE 4

| No. | STEEL No. | | INTERMETALLIC COMPOUND CONTENT (%) | HOMOGENIZING HEAT TREATMENT | RE-HEATING TEMPERATURE (° C.) | REDUCTION AT 1050° C. OR MORE (%) | REDUCTION AT A TEMPERATURE OF 1050 TO 850° C. (%) |
|---|---|---|---|---|---|---|---|
| 41 | a | COMPARATIVE EXAMPLE | 0.40 | 1250° C. × 4 h | 1200 | 60 | 20 |
| 42 | b | COMPARATIVE EXAMPLE | 0.35 | 1250° C. × 4 h | 1200 | 60 | 20 |
| 43 | c | COMPARATIVE EXAMPLE | 0.45 | 1250° C. × 4 h | 1200 | 60 | 20 |
| 44 | d | COMPARATIVE EXAMPLE | 0.05 | 1250° C. × 4 h | 1200 | 60 | 20 |
| 45 | e | COMPARATIVE EXAMPLE | 0.20 | 1250° C. × 4 h | 1200 | 60 | 20 |
| 46 | f | COMPARATIVE EXAMPLE | 0.50 | 1250° C. × 4 h | 1200 | 60 | 20 |
| 47 | g | COMPARATIVE EXAMPLE | 0.13 | 1250° C. × 4 h | 1200 | 60 | 20 |
| 48 | h | COMPARATIVE EXAMPLE | 0.95 | 1250° C. × 4 h | 1200 | 60 | 20 |
| 49 | i | COMPARATIVE EXAMPLE | 0.40 | 1250° C. × 4 h | 1200 | 60 | 20 |
| 50 | j | COMPARATIVE EXAMPLE | 0.30 | 1250° C. × 4 h | 1200 | 60 | 20 |
| 51 | k | COMPARATIVE EXAMPLE | 0.15 | 1250° C. × 4 h | 1200 | 60 | 20 |
| 52 | l | COMPARATIVE EXAMPLE | 0.90 | 1250° C. × 4 h | 1200 | 60 | 20 |
| 53 | m | COMPARATIVE EXAMPLE | 0.00 | 1250° C. × 4 h | 1200 | 60 | 20 |
| 54 | n | COMPARATIVE EXAMPLE | 0.25 | 1250° C. × 4 h | 1200 | 60 | 20 |
| 55 | o | COMPARATIVE EXAMPLE | 0.30 | 1250° C. × 4 h | 1200 | 60 | 20 |
| 56 | p | COMPARATIVE EXAMPLE | 0.10 | 1250° C. × 4 h | 1200 | 60 | 20 |
| 57 | q | COMPARATIVE EXAMPLE | 0.20 | 1250° C. × 4 h | 1200 | 60 | 20 |

TABLE 4-continued

| | | | | | | | |
|---|---|---|---|---|---|---|---|
| 58 | r | COMPARATIVE EXAMPLE | 0.15 | 1250° C. × 4 h | 1200 | 60 | 20 |
| 59 | s | COMPARATIVE EXAMPLE | 0.30 | 1250° C. × 4 h | 1200 | 60 | 20 |
| 60 | t | COMPARATIVE EXAMPLE | 0.30 | 1250° C. × 4 h | 1200 | 60 | 20 |
| 61 | u | COMPARATIVE EXAMPLE | 0.30 | 1250° C. × 4 h | 1200 | 60 | 20 |
| 62 | v | COMPARATIVE EXAMPLE | 0.15 | 1250° C. × 4 h | 1200 | 60 | 20 |
| 63 | w | COMPARATIVE EXAMPLE | 0.10 | 1250° C. × 4 h | 1200 | 60 | 20 |

| No. | STEEL No. | | ROLLING FINISHING TEMPERATURE (° C.) | COOLING RATE AT A TEMPERATURE OF 800 TO 500° C. (° C./min) | SOLUTION HEAT TREATMENT | EAR CRACK (mm) | PROOF STRESS (MPa) | vE −40° C. (J/cm$^2$) | Vc' 100 (mV vs Saturated Ag/AgCl) |
|---|---|---|---|---|---|---|---|---|---|
| 41 | a | COMPARATIVE EXAMPLE | 900 | 250 | UNDONE | 5 | 695 | 199 | 455 |
| 42 | b | COMPARATIVE EXAMPLE | 900 | 250 | UNDONE | 10 | 726 | 65 | 730 |
| 43 | c | COMPARATIVE EXAMPLE | 900 | 250 | UNDONE | 8 | 705 | 77 | 490 |
| 44 | d | COMPARATIVE EXAMPLE | 900 | 250 | UNDONE | 50 | 728 | 75 | 550 |
| 45 | e | COMPARATIVE EXAMPLE | 900 | 250 | UNDONE | 45 | 700 | 53 | 435 |
| 46 | f | COMPARATIVE EXAMPLE | 900 | 250 | UNDONE | 0 | 752 | 71 | 520 |
| 47 | g | COMPARATIVE EXAMPLE | 900 | 250 | UNDONE | 6 | 644 | 310 | 405 |
| 48 | h | COMPARATIVE EXAMPLE | 900 | 250 | UNDONE | 9 | 644 | 30 | 765 |
| 49 | i | COMPARATIVE EXAMPLE | 900 | 250 | UNDONE | 0 | 621 | 195 | 470 |
| 50 | j | COMPARATIVE EXAMPLE | 900 | 250 | UNDONE | 12 | 718 | 35 | 510 |
| 51 | k | COMPARATIVE EXAMPLE | 900 | 250 | UNDONE | 0 | 685 | 222 | 205 |
| 52 | l | COMPARATIVE EXAMPLE | 900 | 250 | UNDONE | 33 | 740 | 20 | 750 |
| 53 | m | COMPARATIVE EXAMPLE | 900 | 250 | UNDONE | 0 | 715 | 215 | 660 |
| 54 | n | COMPARATIVE EXAMPLE | 900 | 250 | UNDONE | 0 | 713 | 30 | 655 |
| 55 | o | COMPARATIVE EXAMPLE | 900 | 250 | UNDONE | 42 | 703 | 150 | 445 |
| 56 | p | COMPARATIVE EXAMPLE | 900 | 250 | UNDONE | 38 | 731 | 156 | 430 |
| 57 | q | COMPARATIVE EXAMPLE | 900 | 250 | UNDONE | 56 | 699 | 164 | 405 |
| 58 | r | COMPARATIVE EXAMPLE | 900 | 250 | UNDONE | 60 | 705 | 142 | 565 |
| 59 | s | COMPARATIVE EXAMPLE | 900 | 250 | UNDONE | 0 | 713 | 61 | 695 |
| 60 | t | COMPARATIVE EXAMPLE | 900 | 250 | UNDONE | 0 | 666 | 52 | 585 |
| 61 | u | COMPARATIVE EXAMPLE | 900 | 250 | UNDONE | 0 | 720 | 30 | 695 |
| 62 | v | COMPARATIVE EXAMPLE | 900 | 250 | UNDONE | 0 | 735 | 70 | 650 |
| 63 | w | COMPARATIVE EXAMPLE | 900 | 250 | UNDONE | 0 | 696 | 21 | 550 |

____: VALUE WITHOUT THE RANGE OF THE PRESENT INVENTION

The steel plate produced under the above condition was cut into HS. No. 4 tension test pieces and JIS. No. 4 V notch Charpy test pieces from a direction perpendicular to the direction of rolling processing. Using the resultant test pieces, 0.2% offset proof stress and impact strength at −40° C. were measured, and farther the surface of the test piece was ground with a #600 grinder and then pitting electrical potential (Vc'100) was measured in a deaerated 10% NaCl aqueous solution held at 50° C., Moreover, test pieces for micro structure observation were cut out, and each of the resultant test pieces was planished and thereafter was subjected to 10% KOH electrolytic etching to reveal intermetallic compound therefrom so as to be observed by an optical microscope, thereby measuring the content. The content was measured by performing point counting in each of ten fields of view with 400× magnification at a depth of each of ¼, ½, and ¾ of thick, and then calculating all average values, and the resultant value was determined as the content of the intermetallic compound of the steel material. The obtained results are shown in Tables 2-4.

The hot-rolling processability was evaluated relatively by judging the generation of an ear crack during the product rolling. It was confirmed that the steel material corresponding to Example 4 to 6 (steel Nos. F to N) developed no ear cracks and exhibited excellent hot-rolling processability, with the exception of the case in which the reheating temperature was excessively high. On the other hand, it was confirmed that each of the steel materials corresponding to each Example other than Examples 4 to 6 developed ear cracks of approximately 5 to 10 mm per one side, so that the yield was decreased slightly. The lengths of ear cracks are shown in Tables 2 to 4.

As provided in the results shown in Tables 1 and 2-4, regarding the steel material which satisfies the steel composition which is within the scope of the present invention, the intermetallic compound content, production condition, all of the corrosion resistance, the proof stress, and Charpy impact value satisfy the specified conditions.

As can be seen from the above examples, it is clarified that the steel material according to the exemplary embodiments of the present invention is an austenitic stainless steel material which excels in corrosion resistance, toughness, and strength.

The exemplary embodiments of the present invention provide an austenitic stainless steel suitable for the hull structures of ships, having excellent performance required for structural members of high-speed ships, such as sea water resistance, proof stress, and low-temperature toughness at a high level, and hence the contributions of the present invention to industry are significant.

The eighth exemplary embodiment of the present invention is described as follows The content of C can be provided to be not more than 0.03%, in order to secure the corrosion resistance of the stainless steel. If the content of C exceeds 0.03%, then Cr carbide will be generated and corrosion resistance and toughness will deteriorate.

The content of Si is not less than 0.1% for deoxidation. However, if the content of Si exceeds 1.5%, then toughness will deteriorate. Therefore, the upper limit thereof is restricted to 1.5%. The content of Si preferably ranges from 0.2 to 1.0%.

The content of Mn is not less than 0.1% for deoxidation. However, if the content of Mn exceeds 3.0%, then corrosion resistance and toughness will deteriorate. Therefore, the upper limit thereof is restricted to 3.0%. The content of Mn preferably ranges from 0.2 to 1.5%.

The content of P is restricted to not more than 0.05% because P deteriorates hot-rolling processability and toughness. The content of P is preferably not more than 0.03%.

The content of S is restricted to not more than 0.003% because S deteriorates hot-rolling processability, toughness, and corrosion resistance. The content of S is preferably not more than 0.001%.

The content of Ni is not less than 15.0% because Ni stabilizes an austenitic phase, and improves resistance to various acids and toughness. On the other hand, Ni is an expensive metal, and hence the content of Ni is restricted to not more than 21.0% from the viewpoint of cost.

The content of Cr is not less than 22.0% for securing basic corrosion resistance. On the other hand, if the content of Cr exceeds 28.0%, then an intermetallic compound will likely be deposited to deteriorate toughness. For this reason, the content of Cr is restricted to not less than 22.0% and not more than 28.0%.

The content of Mo is not less than 1.5% in the present invention, because Mo is a very effective element which increases corrosion resistance of stainless steel additionally. On the other hand, Mo is a very expensive element and which accelerates the deposition of intermetallic compounds, as well as Cr, and hence the upper limit of the content of Mo is restricted to not more than 3.5%. The content of Mo preferably ranges from 2.0 to 3.0%.

N is an effective element which is intercrystallized into an austenitic phase to increase strength and corrosion resistance. For this reason, the content of N is not less than 0.15%. Although it is possible to make N be intercrystallized into the base material up to 0.4% in the steel material of the present invention, the upper limit of the content of N is determined as 0.35% in order to increase sensitivity to generation of bubbling during welding. The content of N is preferably not more than 030%.

Al is an important element for deoxidation of steel, and hence the content of Al is not less than 0.005% in order to reduce oxygen in steel. On the other hand, Al is an element having a comparatively high chemical affinity with N, and if the content of Al is excessive, then AlN is generated to deteriorate toughness of the stainless steel. Although the degree thereof depends on the content of N, if the content of Al exceeds 0.1%, then toughness will deteriorate significantly, and hence the upper limit of the content of Al is determined to be 0.1%.

O is an important element which constitutes an oxide which is a representative nonmetallic inclusion, and excessive addition of O deteriorates toughness, on the other hand if a coarse cluster-like oxide generates, then it causes surface cracking. For this reason, the upper limit of the content of 0 is determined as 0.007%. The content of O is preferably not more than 0.004%.

The PI value expressed by the above-mentioned formula (1): A pitting index is an index of corrosion resistance of stainless steel to a chloride environment, and it is necessary to set the PI value to be not less than 35 at least, in order to acquire the corrosion resistance corresponding to the purpose. As a stainless steel of which the PI value exceeds 40, SUS836L etc., is exemplary, however, such a stainless steel contains Ni in an amount of not less than 24% and hence is very expensive. In the present invention, since the aim is to provide austenitic stainless steel which has corrosion resistance corresponding to cost, the upper limit of PI value is determined to be 40. Note, the value of W in formula (1) is set to 0 in the present invention which does not contain W.

The δ cal expressed by the above-mentioned formula (2) is an index indicating the quantity of the delta ferrite which appears in the solidified configuration of austenitic stainless steel, and the δ cal is in general controlled to be approximately 0 to 7% in order to reduce solidification crack sensitivity or to make the configuration fine. However, as in the stainless steel of the present invention having a high content of Cr, delta ferrite in the solidified configuration changes into an intermetallic compound during the hot-rolling production process and it remains in the steel material as a by-product, thereby deteriorating toughness. For this reason, the upper limit of the δ cal is restricted to +4 so that delta ferrite will decrease. If the δ cal exceeds this value, then it becomes impossible to acquire high toughness even if elaborating a plan in the hot-rolling production process. On the other hand, if the δ cal is shifted to a smaller (minus) side, then it means that the delta ferrite content becomes substantially 0%, and as a result the above effect will be saturated, in addition, the content of Ni becomes excessive, and hence the lower limit of the δ cal is determined to be −6 from the viewpoint of cost. The δ cal value preferably ranges from −3 to +3. Note, the value of W or the value of Cu in formula (2) is set to 0 in the exemplary embodiment of the present invention which does not contain W or Cu.

The content of intermetallic compounds contained in the steel material is an important factor which determines the toughness of the austenitic stainless steel material in the present invention. An intermetallic compound is a compound which contains Cr, Mo, or W as a main ingredient and is called a phase and χ phase. The content of this compound can be measured by subjecting a micro configuration to an alkaline electrolytic etching and then observing the resultant micro configuration through an optical microscope of approximately 400× power. The inventors of the present invention have found that if this content as an average value of a stainless steel cross sectional observation exceeds 0.5%, then the Charpy absorbed energy of the steel material becomes less than 100 J/cm$^2$, and as a result, they determined the upper limit of the content to be 0.5%.

The ninth exemplary embodiment of the present invention is described as follows

Cu is an element which increases the corrosion resistance of stainless steel additionally against an acid, and the content of Cu may be not less than 0.1% for this purpose. Even if the content Cu exceeds 2.0%, the effect corresponding to cost will be saturated, and hence the upper limit of the content of Cu is set to be 2.0%.

Ti is an element which forms an oxide, a nitride, and sulfide with a very small amount thereof; thereby refining the crystal grain of the steel, and hence Ti is an element which may be positively utilized in the steel of the present invention. In order to reduce the intermetallic compound content in the steel material, it is effective to restrict the upper limit of the δ cal value and to perform homogenizing heat treatment of the semi-finished products. Among these, in the latter method, although a heat treatment is performed for several hours at a high temperature of approximately 1250° C., if Ti of a proper amount is contained, then the growth of the crystal grain at such a high temperature can be suppressed. For this purpose, Ti in an amount of not less than 0.003% needs to be contained. On the other hand, Ti is an element which has a very high nitride producing ability, and if the content of Ti exceeds 0.03% in the steel of the present invention which contains N, then coarse TiN will deteriorate the toughness of the steel. For this reason, the content of Ti is determined to be within the range of 0.003 to 0.03%. The content of Ti preferably ranges from 0.005 to 0.02%.

Nb forms carbide to fix C, so that generation of Cr carbide is suppressed, thereby increasing corrosion resistance and toughness. Moreover, Nb forms nitride to suppress growth of crystal grain, thereby converting the steel material into fine particles to increase strength. In order to improve corrosion resistance and to increase strength, not less than 0.02% of Nb can be added. However, if more than 0.2% of Nb is added, then a large amount of carbo-nitride of Nb will be deposited during the hot-rolling processing to deteriorate hot-rolling recrystallization, thereby maintaining a coarse configuration in the steel material as a product, and hence the upper limit of the content of Nb is determined to be 2%. The content of Nb preferably ranges from 0.05 to 0.15%.

V is an element which generates a carbo-nitride as well as Nb, and can be added in order to secure corrosion resistance and toughness. Although not less than 0.05% of V should be contained for this purpose, if more than 0.5% of V is contained, then coarse V series carbo-nitride will be generated, so that toughness will deteriorate conversely. Therefore, the upper limit of the content of V is restricted to 0.5%. Preferably, the content of V can have a range from 0.1 to 0.3%.

W is an element which raises the corrosion resistance of stainless steel additionally as well as Mo, and 0.3 to 3.0% of W can be contained in the stainless steel of the exemplary embodiment of the present invention for this exemplary purpose.

Furthermore, each of B, Ca, Mg, and REM(s) is an element which improves the hot-rolling processability, and one or more of these is added for this purpose. If any of these is added in excess, then it deteriorates the hot-rolling processability, and hence the upper limit and the lower limit of content thereof are determined as follows. The content of B ranges from 0.0003 to 0.0060%, each of the content of Ca and Mg ranges from 0.0005 to 0.0050%, and the content of REM ranges from 0.005 to 0.10%. Here, REM is defined to be the total of the content of lanthanide series rare-earth elements such as La, Ce, etc.

The tenth exemplary embodiment of the present invention is described as follows

In order to raise the toughness of steel materials in the present invention, the amount of intermetallic compound which is contained in the steel material is restricted to be not more than 0.5%. To achieve this, a chemical composition formula known as δ cal, which forecasts delta ferrite, amount contained in a solidification structure configuration, and homogenizing heat treatment which is performed on a semi-finished product specified in this exemplary embodiment are exemplary. When there is no solidifying segregation in the target steel material of the present invention, the temperature at which an intermetallic compound is generated is approximately not higher than 1000° C. However, reduction of the content of an intermetallic compound in the semi-finished product accompanied by component segregation by solidification necessitates a production step for diffusing segregation so as to be homogenized. Although each of the temperature and the time for performing homogenizing heat treatment changes slightly, depending on chemical composition such as solidifying rate, cross-sectional area of a cast steel, degree of hot-rolling processing upon being shaped into a semi-finished product, δ cal, etc., each of the temperature and the time for performing homogenizing heat treatment is limited by diffusion of Cr, Mo, Ni, etc., and hence it necessitates a temperature of not lower than 1200° C. On the other hand, if the temperature exceeds 1300° C., then oxidized scales may be generated extraordinarily.

Moreover, although it is preferred that the time be as long as possible, at least 1 hour is needed. Moreover, this purpose can also be attained by performing soaking at 1200° C. for not less than 1 hour in heating of the semi-finished product for rolling the product. Because of the above reason, homogenizing heat treatment of not less than 1 hour at 1200-1300° C. is specified. In view of effect and economical efficiency, the soaking time preferably ranges from 2 to 20 hours.

Example 2

The Chemical composition of a sample steel is shown in Table 5 herein. The content of inevitable impurity elements other than the components indicated in Table 5 is the same grade as in standard stainless steel. Moreover, the portion which shows no content of the components shown in Table 5 indicates the same grade as in impurities. In addition, REM in Table 5 means lanthanide series rare-earth elements, and the content thereof indicates the total content of each of those elements.

Each of these steels was melted in a 50 kg vacuum induction furnace of a laboratory, and each of them was cast into a flat steel ingot having a thickness of approximately 100 mm.

TABLE 5

| STEEL No. | KIND | CONTENT (mass %) C | Si | Mn | P | S | Ni | Cr | Mo | Cu | Nb | Ti |
|---|---|---|---|---|---|---|---|---|---|---|---|---|
| 0 | EXAMPLE 7 | 0.019 | 0.51 | 0.45 | 0.023 | 0.0005 | 18.03 | 25.01 | 2.48 | | | |
| 1 | EXAMPLE 8 | 0.021 | 0.49 | 0.48 | 0.020 | 0.0007 | 17.91 | 25.24 | 2.50 | 0.15 | | |
| 2 | EXAMPLE 8 | 0.018 | 0.52 | 0.52 | 0.014 | 0.0012 | 17.98 | 25.02 | 2.46 | | | 0.008 |
| 3 | EXAMPLE 9 | 0.022 | 0.49 | 0.52 | 0.022 | 0.0008 | 18.43 | 24.88 | 2.46 | 0.29 | 0.096 | |
| 4 | EXAMPLE 9 | 0.021 | 0.48 | 0.52 | 0.022 | 0.0007 | 17.38 | 25.36 | 2.53 | 0.30 | 0.034 | 0.006 |
| 5 | EXAMPLE 9 | 0.022 | 0.46 | 0.52 | 0.021 | 0.0008 | 20.21 | 24.96 | 2.46 | 0.31 | 0.103 | 0.015 |
| 6 | EXAMPLE 9 | 0.022 | 0.48 | 0.49 | 0.022 | 0.0003 | 19.23 | 24.32 | 3.33 | 0.28 | | |
| 7 | EXAMPLE 9 | 0.021 | 0.47 | 0.52 | 0.022 | 0.0007 | 18.33 | 24.66 | 2.48 | 0.32 | | 0.005 |
| 8 | EXAMPLE 9 | 0.019 | 0.45 | 0.53 | 0.023 | 0.0008 | 18.23 | 24.65 | 2.46 | 0.32 | | 0.003 |
| 9 | EXAMPLE 9 | 0.021 | 0.48 | 0.51 | 0.023 | 0.0008 | 18.52 | 24.03 | 2.46 | 0.32 | | 0.006 |
| 10 | EXAMPLE 9 | 0.019 | 0.49 | 0.49 | 0.022 | 0.0004 | 20.42 | 27.31 | 1.68 | 0.31 | 0.042 | 0.006 |
| 11 | EXAMPLE 9 | 0.024 | 0.49 | 0.49 | 0.021 | 0.0003 | 19.53 | 25.61 | 2.11 | 1.82 | | 0.012 |
| 12 | EXAMPLE 9 | 0.019 | 0.49 | 0.85 | 0.019 | 0.0013 | 18.89 | 25.29 | 2.52 | 0.32 | 0.076 | 0.004 |
| 13 | EXAMPLE 9 | 0.021 | 0.50 | 0.84 | 0.019 | 0.0005 | 16.77 | 24.66 | 2.10 | 0.85 | | 0.006 |
| 14 | EXAMPLE 9 | 0.021 | 0.26 | 1.85 | 0.022 | 0.0009 | 19.53 | 24.33 | 3.45 | 0.31 | 0.152 | 0.022 |
| 15 | EXAMPLE 9 | 0.018 | 0.56 | 0.53 | 0.021 | 0.0006 | 16.95 | 22.21 | 3.39 | 1.66 | | 0.007 |
| 21 | COMPARATIVE STEEL EXAMPLE | 0.021 | 0.48 | 0.53 | 0.023 | 0.0008 | 18.23 | 24.89 | 2.46 | 0.32 | | 0.046 |
| 22 | COMPARATIVE STEEL EXAMPLE | 0.022 | 0.47 | 0.54 | 0.024 | 0.0007 | 18.33 | 25.00 | 2.45 | 0.35 | 0.284 | |
| 23 | COMPARATIVE STEEL EXAMPLE | 0.023 | 0.46 | 0.55 | 0.023 | 0.0008 | 18.25 | 24.98 | 2.48 | 0.32 | | |
| 24 | COMPARATIVE STEEL EXAMPLE | 0.024 | 0.45 | 0.52 | 0.024 | 0.0006 | 18.22 | 24.94 | 2.47 | 0.31 | | |
| 25 | COMPARATIVE STEEL EXAMPLE | 0.022 | 0.47 | 0.53 | 0.025 | 0.0008 | 18.21 | 24.96 | 2.46 | 0.33 | | |
| 26 | COMPARATIVE STEEL EXAMPLE | 0.021 | 0.48 | 0.51 | 0.024 | 0.0007 | 17.01 | 25.11 | 2.88 | 0.31 | | |
| 27 | COMPARATIVE STEEL EXAMPLE | 0.022 | 0.49 | 0.52 | 0.023 | 0.0008 | 21.40 | 24.95 | 2.47 | 0.33 | | |

| STEEL No. | KIND | CONTENT (mass %) V | W | Al | B | Ca | Mg | REM | O | N | δ cal | PI |
|---|---|---|---|---|---|---|---|---|---|---|---|---|
| 0 | EXAMPLE 7 | | | 0.023 | | | | | 0.0027 | 0.275 | −1.1 | 37.6 |
| 1 | EXAMPLE 8 | | | 0.020 | | | | | 0.0046 | 0.235 | 1.7 | 37.3 |
| 2 | EXAMPLE 8 | | | 0.018 | | | | | 0.0041 | 0.266 | −0.5 | 37.4 |
| 3 | EXAMPLE 9 | 0.06 | | 0.032 | | 0.0023 | | | 0.0018 | 0.240 | −1.3 | 36.8 |
| 4 | EXAMPLE 9 | | | 0.026 | | 0.0022 | | | 0.0023 | 0.238 | 3.2 | 37.5 |
| 5 | EXAMPLE 9 | | | 0.028 | | 0.0025 | | | 0.0025 | 0.242 | −5.8 | 37.0 |
| 6 | EXAMPLE 9 | 0.15 | | 0.034 | 0.0035 | | | | 0.0019 | 0.257 | −3.3 | 39.4 |
| 7 | EXAMPLE 9 | | 0.35 | 0.022 | | 0.0025 | | | 0.0026 | 0.235 | −0.8 | 37.2 |
| 8 | EXAMPLE 9 | | 1.05 | 0.023 | | 0.0008 | 0.0033 | | 0.0035 | 0.247 | −0.1 | 38.5 |
| 9 | EXAMPLE 9 | | 2.10 | 0.024 | | 0.0024 | | | 0.0029 | 0.241 | −0.9 | 39.5 |
| 10 | EXAMPLE 9 | | | 0.011 | 0.0023 | 0.0023 | | | 0.0036 | 0.245 | −1.6 | 36.8 |
| 11 | EXAMPLE 9 | 0.28 | | 0.023 | | 0.0020 | | | 0.0025 | 0.173 | −0.7 | 35.3 |
| 12 | EXAMPLE 9 | | | 0.020 | | 0.0008 | | 0.050 | 0.0040 | 0.235 | −0.9 | 37.4 |
| 13 | EXAMPLE 9 | 0.07 | | 0.018 | | 0.0042 | | | 0.0020 | 0.315 | −3.1 | 36.6 |
| 14 | EXAMPLE 9 | | | 0.020 | | 0.0019 | 0.0008 | | 0.0032 | 0.184 | −1.1 | 38.7 |
| 15 | EXAMPLE 9 | 0.12 | | 0.024 | | 0.0030 | | | 0.0032 | 0.188 | −0.2 | 36.4 |
| 21 | COMPARATIVE STEEL EXAMPLE | | | 0.026 | | 0.0025 | | | 0.0032 | 0.241 | −0.7 | 36.9 |
| 22 | COMPARATIVE STEEL EXAMPLE | | | 0.026 | | 0.0026 | | | 0.0033 | 0.242 | −0.9 | 37.0 |
| 23 | COMPARATIVE STEEL EXAMPLE | 0.88 | | 0.024 | | 0.0025 | | | 0.0031 | 0.239 | −0.6 | 37.0 |
| 24 | COMPARATIVE STEEL EXAMPLE | | | 0.140 | | 0.0024 | | | 0.0032 | 0.240 | −0.8 | 36.9 |
| 25 | COMPARATIVE STEEL EXAMPLE | | | 0.002 | | 0.0036 | | | 0.0081 | 0.242 | −0.6 | 37.0 |
| 26 | COMPARATIVE STEEL EXAMPLE | | | 0.023 | | 0.0022 | | | 0.0029 | 0.237 | 4.5 | 38.4 |

TABLE 5-continued

| | | | | | | | |
|---|---|---|---|---|---|---|---|
| 27 | COMPARATIVE STEEL EXAMPLE | 0.026 | 0.0023 | 0.0030 | 0.240 | −8.8 | 36.9 |

___: VALUE WITHOUT THE RANGE OF THE PRESENT INVENTION

The sample steel was subjected to cogging, homogenizing heat treatment, and pr-duct rolling. In the cogging, the sample steel was soaked at 1180° C. for two hours, and thereafter the sample steel was rolled to 65 mm thickness. Then the resultant semi-finished products were subjected to homogenizing heat treatment at a temperature ranging from 1220 to 1280° C. Some of the semi-finished products were not subjected to the homogenizing heat treatment. Each piece of steel was ground to 60 mm to obtain the material for use in product rolling. In the product rolling, the sample was soaked at 1220° C. for 1 to 2 hours, and thereafter was rolled under the condition of a finishing temperature of 850 to 950° C. to obtain a steel sheet having a thickness of 12 mm. It should be noted that the steel material immediately after being hot-rolled which was in a temperature state of not less than 800° C. was cooled to a temperature of not higher than 300° C. by performing spray cooling. The final solution heat treatment was performed under a condition of cooling with water after performing soaking at 1100° C. for 20 min. Moreover, some steel sheets were not subjected to the solution heat treatment.

The steel plate produced under the above condition was cut into JIS. No. 4 tension test pieces and JIS. No. 4 V notch Charpy test pieces from a direction perpendicular to the direction of rolling processing. Using the resultant test pieces, 0.2% offset proof stress and impact strength at −40° C. were measured. Moreover, test pieces for micro configuration observation were cut out, and each of the resultant test pieces was planished and thereafter was subjected to 10% KOH electrolytic etching to reveal the intermetallic compound therefrom so as to be observed by an optical microscope, thereby measuring the content. The content was measured by performing point counting in each often fields of view with 400× magnification at a depth of each of ¼, ½, and ¾ of thickness, and then calculating all the average values, and the resultant value was determined as the content of the intermetallic compound of the steel material. The obtained results are shown in Table 6.

TABLE 6

| STEEL NO. | KIND | INTERMETALLIC COMPOUND CONTENT (%) | HOMOGENIZING HEAT TREATMENT | ROLLING FINISHING TEMPERATURE (° C.) | SOLUTION HEAT TREATMENT | YS (MPa) | TS (MPa) | vE − 40° C. (J/cm$^2$) | EAR CRACK (mm) |
|---|---|---|---|---|---|---|---|---|---|
| 0 | EXAMPLE | 0.02 | 1250° C. × 4 h | 950 | DONE | 392 | 782 | 540 | 6 |
| 0 | EXAMPLE | 0.05 | 1250° C. × 4 h | 850 | DONE | 396 | 793 | 491 | 9 |
| 0 | EXAMPLE | 0.17 | 1250° C. × 4 h | 950 | UNDONE | 747 | 965 | 195 | 6 |
| 0 | COMPARATIVE EXAMPLE | 0.75 | UNDONE | 850 | UNDONE | 892 | 1054 | 68 | 12 |
| 1 | EXAMPLE | 0.05 | 1250° C. × 4 h | 950 | DONE | 340 | 751 | 503 | 5 |
| 1 | EXAMPLE | 0.10 | 1250° C. × 4 h | 850 | DONE | 344 | 762 | 452 | 8 |
| 1 | EXAMPLE | 0.20 | 1250° C. × 4 h | 950 | UNDONE | 722 | 943 | 183 | 5 |
| 1 | COMPARATIVE EXAMPLE | 1.2 | UNDONE | 850 | UNDONE | 841 | 1020 | 35 | 10 |
| 2 | EXAMPLE | 0.03 | 1250° C. × 4 h | 950 | DONE | 352 | 766 | 542 | 5 |
| 2 | EXAMPLE | 0.06 | 1250° C. × 4 h | 850 | DONE | 357 | 771 | 482 | 7 |
| 2 | EXAMPLE | 0.18 | 1250° C. × 4 h | 950 | UNDONE | 736 | 954 | 163 | 5 |
| 2 | COMPARATIVE EXAMPLE | 0.8 | UNDONE | 850 | UNDONE | 882 | 1065 | 62 | 10 |
| 3 | EXAMPLE | 0.02 | 1250° C. × 4 h | 950 | DONE | 388 | 779 | 558 | 0 |
| 3 | EXAMPLE | 0.05 | 1250° C. × 4 h | 850 | DONE | 394 | 782 | 509 | 0 |
| 3 | EXAMPLE | 0.15 | 1250° C. × 4 h | 950 | UNDONE | 732 | 947 | 214 | 0 |
| 3 | COMPARATIVE EXAMPLE | 0.7 | UNDONE | 850 | UNDONE | 865 | 1033 | 70 | 0 |
| 3 | COMPARATIVE EXAMPLE | 0.55 | UNDONE | 900 | UNDONE | 812 | 982 | 93 | 0 |
| 3 | EXAMPLE | 0.42 | UNDONE | 950 | UNDONE | 742 | 949 | 116 | 0 |
| 4 | EXAMPLE | 0.45 | 1220° C. × 1 h | 950 | UNDONE | 356 | 768 | 105 | 0 |
| 4 | EXAMPLE | 0.36 | 1250° C. × 2 h | 950 | UNDONE | 356 | 766 | 114 | 0 |
| 4 | EXAMPLE | 0.23 | 1250° C. × 4 h | 900 | UNDONE | 358 | 765 | 135 | 0 |
| 4 | EXAMPLE | 0.15 | 1250° C. × 20 h | 950 | UNDONE | 352 | 764 | 167 | 0 |
| 4 | EXAMPLE | 0.22 | 1280° C. × 2 h | 950 | UNDONE | 347 | 762 | 133 | 0 |
| 5 | EXAMPLE | 0.02 | 1250° C. × 4 h | 850 | DONE | 393 | 785 | 564 | 0 |
| 5 | EXAMPLE | 0.08 | 1250° C. × 4 h | 950 | UNDONE | 745 | 960 | 265 | 0 |
| 6 | EXAMPLE | 0.05 | 1250° C. × 4 h | 850 | DONE | 352 | 753 | 508 | 0 |
| 6 | EXAMPLE | 0.12 | 1250° C. × 4 h | 950 | UNDONE | 748 | 962 | 213 | 0 |
| 7 | EXAMPLE | 0.04 | 1250° C. × 4 h | 850 | DONE | 348 | 753 | 526 | 0 |
| 7 | EXAMPLE | 0.16 | 1250° C. × 4 h | 950 | UNDONE | 738 | 958 | 216 | 0 |
| 8 | EXAMPLE | 0.06 | 1250° C. × 4 h | 850 | DONE | 362 | 772 | 492 | 0 |

TABLE 6-continued

| | | | | | | | | | |
|---|---|---|---|---|---|---|---|---|---|
| 8 | EXAMPLE | 0.19 | 1250° C. × 4 h | 950 | UNDONE | 771 | 982 | 165 | 0 |
| 9 | EXAMPLE | 0.08 | 1250° C. × 4 h | 850 | DONE | 388 | 795 | 421 | 0 |
| 9 | EXAMPLE | 0.32 | 1250° C. × 4 h | 950 | UNDONE | 788 | 994 | 132 | 0 |
| 10 | EXAMPLE | 0.03 | 1250° C. × 4 h | 850 | DONE | 352 | 765 | 502 | 0 |
| 10 | EXAMPLE | 0.10 | 1250° C. × 4 h | 950 | UNDONE | 740 | 936 | 165 | 0 |
| 11 | EXAMPLE | 0.05 | 1250° C. × 4 h | 850 | DONE | 324 | 711 | 513 | 0 |
| 11 | EXAMPLE | 0.17 | 1250° C. × 4 h | 950 | UNDONE | 735 | 925 | 164 | 0 |
| 12 | EXAMPLE | 0.05 | 1250° C. × 4 h | 850 | DONE | 362 | 776 | 501 | 0 |
| 12 | EXAMPLE | 0.18 | 1250° C. × 4 h | 950 | UNDONE | 762 | 975 | 168 | 0 |
| 13 | EXAMPLE | 0.05 | 1250° C. × 4 h | 850 | DONE | 375 | 783 | 523 | 0 |
| 13 | EXAMPLE | 0.17 | 1250° C. × 4 h | 950 | UNDONE | 775 | 983 | 185 | 0 |
| 14 | EXAMPLE | 0.11 | 1250° C. × 4 h | 850 | DONE | 342 | 741 | 481 | 0 |
| 14 | EXAMPLE | 0.32 | 1250° C. × 4 h | 950 | UNDONE | 726 | 932 | 135 | 0 |
| 15 | EXAMPLE | 0.09 | 1250° C. × 4 h | 850 | DONE | 348 | 738 | 475 | 0 |
| 15 | EXAMPLE | 0.28 | 1250° C. × 4 h | 950 | UNDONE | 749 | 974 | 140 | 0 |
| 21 | COMPARATIVE EXAMPLE | 0.25 | 1250° C. × 4 h | 950 | UNDONE | 721 | 926 | 85 | 0 |
| 22 | COMPARATIVE EXAMPLE | 0.26 | 1250° C. × 4 h | 950 | UNDONE | 765 | 904 | 76 | 0 |
| 23 | COMPARATIVE EXAMPLE | 0.24 | 1250° C. × 4 h | 950 | UNDONE | 754 | 967 | 83 | 0 |
| 24 | COMPARATIVE EXAMPLE | 0.28 | 1250° C. × 4 h | 950 | UNDONE | 735 | 954 | 92 | 0 |
| 25 | COMPARATIVE EXAMPLE | 0.26 | 1250° C. × 4 h | 950 | UNDONE | 713 | 941 | 78 | 0 |
| 26 | COMPARATIVE EXAMPLE | 0.94 | 1250° C. × 4 h | 950 | UNDONE | 735 | 943 | 45 | 0 |
| 27 | COMPARATIVE EXAMPLE | 0.06 | 1250° C. × 4 h | 950 | UNDONE | 742 | 926 | 198 | 0 |

____: VALUE WITHOUT THE RANGE OF THE PRESENT INVENTION

The hot-rolling processability was evaluated relatively by judging the generation of an ear crack during the product rolling. It was confirmed that the steel material corresponding to Example 9 (steel Nos. 3 to 15) developed no ear cracks and exhibited excellent hot-rolling processability, the other hand, it was confirmed that each of the steel materials corresponding to each Example other than Examples 7 and 8 developed ear cracks of approximately 5 to 12 mm per one side, so that the yield was decreased slightly. The lengths of ear cracks are shown in Table 6. That is, although there is a slight problem in the hot-rolling processability of steel Nos. 0 to 2, in the thick steel which was produced to have the content of an intermetallic compound of not more than 0.5%, each Charpy impact value at −40° C. exceeds 100 J/cm$^2$. As to the steel Nos. 3 to 15, which are those in which Al, B, Ca, Mg, REM are contained in order to improve hot-rolling processability, no ear cracks occurred. Moreover, in Examples of the present invention produced so as to have the content of an intermetallic compound of not more than 0.5%, each Charpy impact value at −40° C. exceeds 100 J/cm$^2$.

Further, in each of the comparative examples of steel Nos. 21 to 27, the content of Ti is less than 0.03%, the content of Nb is more than 0.2%, the content of V is more than 0.5%, the content of Al is more than 0.1%, the content of O is more than 0.007%, the content of δFe is more than 3%, and the content of Ni is more than 21% (δFe<−6%), i.e. each is out of the scope of the present invention, and the comparative examples other than No. 27 have poor impact property. Although the comparative example of steel No. 27 excels in impact property, it has a high content of Ni and hence deviates from one of the objects of the present invention.

As is clear from the results shown in Tables 5 and 6, each of the steel materials which satisfy the steel composition and intermetallic compound content within the scope of the present invention has a PI value, which is an index of corrosion resistance, of not less than 35, and exhibits high strength and a Charpy impact value of not less than 100 J/cm$^2$.

As can be seen from the above examples, it is clarified that the steel material of the exemplary embodiment of the present invention is an austenitic stainless steel material which excels in corrosion resistance, toughness, and hot-rolling processability.

The foregoing merely illustrates the principles of the invention. Various modifications and alterations to the described embodiments will be apparent to those skilled in the art in view of the teachings herein. It will thus be appreciated that those skilled in the art will be able to devise numerous systems, arrangements, computer programs, procedures and methods which, although not explicitly shown or described herein, embody the principles of the invention and are thus within the spirit and scope of the present invention. Indeed, although the exemplary embodiments of the present invention are explained herein, the present invention is not limited thereto. Additions, abbreviations, substitutions, and other changes are possible, as long as do not deviate from the spirit of the present invention.

The present invention realizes an austenitic stainless steel suitable for the hull structures of ships, having excellent performance required for structural members of high-speed ships, such as sea water resistance, proof stress, and low-temperature toughness at a high level, and hence the contributions of the present invention to industry are significant. In addition, to the extent that the prior art knowledge has not been explicitly incorporated by reference herein above, it is explicitly being incorporated herein in its entirety. All publications referenced herein above are incorporated herein by reference in their entireties.

What is claimed is:

1. An austenitic stainless hot-rolled steel material having a superior corrosion resistance and a low-temperature toughness, comprising:

C: not more than 0.03 mass %;

Si: more than 0.3 mass % and not more than 1.5 mass %;

Mn: 0.1 to 3.0 mass %;

P: not more than 0.05 mass %;

S: not more than 0.003 mass %;
Ni: 15.0 to 21.0 mass %;
Cr: 22.0 to 28.0 mass %;
Mo: 1.5 to 3.5 mass %;
N: 0.15 to 0.35 mass %;
Al: 0.005 to 0.1 mass %;
O: not more than 0.007 mass %; and
a remnant of the steel material comprising Fe and substantially inevitable impurities and a content of intermetallic compounds contained in the steel material is not more than 0.5 mass %, wherein
a PI value expressed by the following formula ranges from 35 to 40: PI=Cr+3.3(Mo+0.5W)+16N; and
a δcal value expressed by the following formula ranges from −6 to +4: δ cal=2.9(Cr+0.3Si+Mo+0.5W)−2.6(Ni+0.3Mn+0.25Cu+35C+20N)−18, wherein
a value by each element represents the content of the element expressed in terms of mass %.

2. The austenitic stainless hot-rolled steel material according to claim 1, further comprising: at least one of:
Cu: 0.1 to 2.0 mass %;
Ti: 0.003 to 0.03 mass %;
Nb: 0.02 to 0.20 mass %;
V: 0.05 to 0.5 mass %;
W: 0.3 to 3.0 mass %;
B: 0.0003 to 0.0060 mass %;
Ca: 0.0005 to 0.0050 mass %;
Mg: 0.0005 to 0.0050 mass %; or
REM: 0.005 to 0.10 mass %.

3. A process for producing an austenitic stainless hot-rolled steel material having a superior corrosion resistance and a low-temperature toughness, comprising:
C: not more than 0.03 mass %;
Si: more than 0.3 mass % and not more than 1.5 mass %;
Mn: 0.1 to 3.0 mass %;
P: not more than 0.05 mass %;
S: not more than 0.003 mass %;
Ni: 15.0 to 21.0 mass %;
Cr: 22.0 to 28.0 mass %;
Mo: 1.5 to 3.5 mass %;
N: 0.15 to 0.35 mass %;
Al: 0.005 to 0.1 mass %;
O: not more than 0.007 mass %; and
a remnant of the steel material comprising Fe and substantially inevitable impurities and a content of intermetallic compounds contained in the steel material is not more than 0.5 mass %, wherein
a PI value expressed by the following formula ranges from 35 to 40: PI=Cr+3.3(Mo+0.5W)+16N; and
a δ cal value expressed by the following formula ranges from −6 to +4: δ cal=2.9(Cr+0.3Si+Mo+0.5W)−2.6(Ni+0.3Mn+0.25Cu+35C+20N)−18, wherein
a value by each element represents the content of the element expressed in terms of mass %, the process comprising:
performing a homogenizing-heat treatment on a cast steel or a semi-finished product after a rough hot-rolling processing at a temperature of 1200 to 1300° C. for at least one hour in order to reduce the content of the intermetallic compound in the steel material.

4. The process of claim 3, wherein the austenitic stainless, hot rolled steel material having a superior corrosion resistance and a low-temperature toughness further comprises at least one of:
Cu: 0.1 to 2.0 mass %;
Ti: 0.003 to 0.03 mass %;
Nb: 0.02 to 0.20 mass %;
V: 0.05 to 0.5 mass %;
W: 0.3 to 3.0 mass %;
B: 0.0003 to 0.0060 mass %;
Ca: 0.0005 to 0.0050 mass %;
Mg: 0.0005 to 0.0050 mass %; or
REM: 0.005 to 0.10 mass %.

5. The austenitic stainless hot-rolled steel material according to claim 1, wherein Si is 0.45 to 1.5 mass %.

6. The austenitic stainless hot-rolled steel material according to claim 2, wherein Si is 0.45 to 1.5 mass %.

7. The process of claim 3, wherein Si is 0.45 to 1.5 mass %.

8. The process of claim 4, wherein Si is 0.45 to 1.5 mass %.

* * * * *